US007055629B2

(12) United States Patent
Oglesby

(10) Patent No.: US 7,055,629 B2
(45) Date of Patent: Jun. 6, 2006

(54) INVERTED MOTOR FOR DRILLING ROCKS, SOILS AND MAN-MADE MATERIALS AND FOR RE-ENTRY AND CLEANOUT OF EXISTING WELLBORES AND PIPES

(76) Inventor: Kenneth D. Oglesby, 12511 W. 68th St., Sapulpa, OK (US) 74066

( * ) Notice: Subject to any disclaimer, the term of this patent is extended or adjusted under 35 U.S.C. 154(b) by 0 days.

(21) Appl. No.: 11/120,614

(22) Filed: May 3, 2005

(65) Prior Publication Data

US 2005/0189146 A1 Sep. 1, 2005

Related U.S. Application Data

(62) Division of application No. 10/227,985, filed on Aug. 26, 2002, now Pat. No. 6,920,946.

(60) Provisional application No. 60/324,866, filed on Sep. 27, 2001.

(51) Int. Cl.
*E21B 4/02* (2006.01)

(52) U.S. Cl. ..... 175/107; 175/106

(58) Field of Classification Search ..... 175/106, 175/107, 101, 96; 418/61.3
See application file for complete search history.

(56) References Cited

U.S. PATENT DOCUMENTS

| | | | | |
|---|---|---|---|---|
| 1,780,867 | A | | 11/1930 | Cornella |
| 1,790,460 | A | | 1/1931 | Capeliuschnicoff |
| 1,868,825 | A | | 7/1932 | Grosjean |
| 2,108,779 | A | | 2/1938 | Schafer et al. |
| 2,660,402 | A | | 11/1953 | Devine et al. |
| 2,937,008 | A | | 5/1960 | Whittle |
| 2,944,792 | A | * | 7/1960 | Gros ..... 175/107 |
| 3,027,471 | A | | 3/1962 | Burgwin et al. |
| 3,076,514 | A | | 2/1963 | Garrison |
| 3,132,595 | A | | 5/1964 | Bower |
| 3,938,596 | A | | 2/1976 | Ivanov et al. |
| 3,971,450 | A | | 7/1976 | Fox |
| 4,060,141 | A | | 11/1977 | Catterfeld |
| 4,505,031 | A | | 3/1985 | Colwell et al. |
| 4,576,242 | A | | 3/1986 | Mundell |
| 4,606,700 | A | | 8/1986 | Brudny-Chelyadinov et al. |
| 4,692,105 | A | | 9/1987 | Leroy |
| 4,773,489 | A | * | 9/1988 | Makohl ..... 175/107 |
| 5,118,227 | A | | 6/1992 | Gregorio Gracia |
| 5,118,263 | A | | 6/1992 | Fritchman |
| 5,437,338 | A | | 8/1995 | Martin et al. |
| 5,460,496 | A | | 10/1995 | Van-Drentham Susman |

(Continued)

FOREIGN PATENT DOCUMENTS

GB 709608 * 5/1954

*Primary Examiner*—David Bagnell
*Assistant Examiner*—G M Collins
(74) *Attorney, Agent, or Firm*—Head, Johnson & Kachigian

(57) ABSTRACT

An inverted motor with a drilling utensil attached to or integrated as part of an outer motor housing that rotates around a fixed non-rotating shaft or tube. The non-rotating shaft or tube is attached to a fixed base and can extend to the end or past the end of the drilling utensil. A rotary motor is positioned between the outer rotating housing and center fixed shaft and imparts force and motion to the housing and drilling utensil. A channel traverses through the length of the shaft or tube to allow fluids or wires to fully or partially bypass the motor.

31 Claims, 11 Drawing Sheets

U.S. PATENT DOCUMENTS 5,518,379 A 5/1996 Harris et al.
5,785,509 A 7/1998 Harris et al.
5,833,444 A 11/1998 Harris et al.
5,853,052 A 12/1998 Baiden et al.
5,918,728 A 7/1999 Syverson
5,939,813 A 8/1999 Schob
6,202,762 B1 * 3/2001 Fehr et al. ..... 175/107
6,488,103 B1 12/2002 Dennis et al.

* cited by examiner

INVERTED MOTOR FOR DRILLING ROCKS, SOILS AND MAN-MADE MATERIALS AND FOR RE-ENTRY AND CLEANOUT OF EXISTING WELLBORES AND PIPES

REFERENCE TO PENDING APPLICATIONS

This is a divisional application of Ser. No. 10/227,985 filed on Aug. 26, 2002, now U.S. Pat. No. 6,920,946.

This application relates back to provisional application, Ser. No. 60/324,866 filed Sep. 27, 2001, and incorporated by reference herein its intirety.

REFERENCE TO MICROFICHE APPENDIX

This application is not referenced in any Microfiche Appendix.

FIELD OF THE INVENTION

This invention relates generally to the field of motors utilized in drilling operations of rock, soil, concrete and man-made materials, and, more particularly to inverted motors for drilling rocks, soils, concrete and man-made materials, including the re-entry and clean out of existing wellbores, pipes and pipelines.

BACKGROUND OF THE INVENTION

Contemporary art in wellbore related applications utilize a diversely structured hollow tubular string, which extends from one end at the earth's surface to an opposite end at or near the bottom of a wellbore where a cutting bit and related equipment (sometimes and herein referred to synonymously as "drilling utensil") is attached to the tubular string. Said drilling utensils are used to bore through rock to extend the hole to a desired depth and location. Fluids utilized typically include water, oil, "mud", acids and/or gas such as air, nitrogen or natural gas. Such fluids are pumped down the interior of the string, through the bit, cooling the bit, washing drilled rock cuttings from the bit face and lifting those rock cuttings tip to the surface where they are removed from the fluid. If the tubular string is jointed, then the downhole bit can be rotated from the surface. If the tubular string is either jointed or continuous, the downhole bit can be rotated utilizing a downhole hydraulic/pneumatic, positive displacement/turbine, or electric motor that is installed just above the bit to turn the bit without turning the tubular drill string. As the bit cuts and the circulated fluid moves the cuttings away from the bit/drilling utensil tip and up the wellbore to the surface, the bit and tubing string are lowered so that the bit maintains contact with the bottom of the hole that continues the drilling process. The above procedures are also utilized to clean out and re-enter existing wellbores or plugged wellbores.

In drilling operations utilizing downhole motors of the contemporary art, circulating fluid (liquids and/or gas) is pumped into the interior of a hollow tubular string, down the tubular string directly into the motor section (void between the motor housing and shaft where the resides the motor's stator and rotor elements), through the motor section powering the motor, transitioning from the outside of the internal rotating shaft into the shaft at the end of the motor section, into a bit flow channel inside the bit, then exiting through the end of the bit/drilling utensil. The exiting fluid then cleans and removes the rock cuttings generated by this process from the bit/utensil face and lifts them past the motor housing and up the hole to the surface. Minimum flow rate and pressure requirements of the circulating fluid necessary to efficiently clean and lift rock cuttings to the surface are well known to those skilled in the art. Should minimum flow rate not be achieved and maintained, the drilling process will be impaired or bound—sometimes with the tubular string and drilling equipment becoming stuck in the well. It is important to note that the fluid type, flow rate and pressure requirements of a given motor may significantly vary from the hydraulic flow requirements to clean the wellbore. Consequently, allowance for additional fluid volumes are often required to bypass the motor section and, when required, high pressure fluids of known volumes and pressures should be delivered to/near the tool/bit tip directly. Such fluid "by-pass" capability through the motor to the lead bit/drilling utensil, however, is not available to the industry via technology of the contemporary art.

Recent improvements have been made in the drilling of oil and gas, environmental and service wells and pipeline and utility boreholes, especially in the ability to direct, guide and control drilling operation in non-vertical directions, allowing a bottom-hole location to be offset from the surface (hole) location. Indeed, today, a well's bottom-hole location can be miles distant from its corresponding surface location. To do this with contemporary downhole motors, a bent sub (short piece of the tubular string with a fixed bend in it) is placed above the motor encouraging or causing the cutting bit to change axial direction. Contemporary art requires more than 60 feet of generally vertical distance to transcend the drilling operations from a vertical to a horizontal orientation, with the industry aggressively striving to shorten this curve length. Some of the barriers to shorten this curve length are the motors' length, diameter and torque capabilities. The derived benefits from such curved or bent drilling operations are to maximize the length of the hole within the zone of interest, to lessen rig time and costs, and to minimize costly potential well problems.

Downhole motors used in drilling applications are typically hydraulic and/or (more recently) pneumatic powered, positive displacement motors. Widely recognized hydraulic and pneumatic motors are of the Moineau and roller vane types. Electric and turbine powered motors can also be used for downhole operations, but are not widely practiced within the contemporary art. Motors that require clean power fluids are typically not used currently in the industry as well. Air (pneumatic) hammers and bits are rarely used below such downhole motors although the benefits of such have been recognized. Hydraulic hammers are being developed currently.

In all known motor designs of the contemporary art, the motor housing is affixed to the tubular string (extended from the surface, hereafter also called the "base") and is therefore non-rotating relative to the base/tubing string; the internal shaft is rotated relative to the housing and base by the motor (with stator and rotor situated between the fixed housing and rotating shaft); and the drilling utensil is directly attached to the downhole end of the shaft which extends out of the motor housing and is thusly rotated. All known such contemporary motors have flow rate, pressure and speed limitations (both minimum and maximum) that must be met to ensure proper motor operation.

As stated earlier, all liquids, gases and solids utilized in this process of the contemporary art must go through the motor section to get to the drilling utensil for bit and bearing cooling and bit cleaning. While some fluids can be vented into the drilled hole (void outside of the drill string and tools) before the motor section and, therefore, not get to the bit or motor, the reverse option (i.e. more fluid getting to the bit than going through the motor) is not possible. This fact requires the maximum flow rate of a chosen motor must sufficiently cool and clean the tools, bit and hole drilled in the well.

The most common Moineau type downhole motors used for drilling purposes typically fall between a minimum 6 to over 30 feet in length; are relatively inflexible; are limited by temperature and pressure due to the utilized rubber elements; are sensitive to the hydraulic power fluid utilized (i.e. no acids and few solvents) due to the nibber elements; and are limited by minimum and maximum flow rates of the power fluid. Such limitations restrict the use of Moineau motors for highly deviated/directional/curved drilled holes; for pumping acids, bases, solvents and other corrosive fluids; for high pressure and temperature applications; and for high flow rate applications. These motor requirements and limitations are well known to those skilled in the practice of the art. Another limitation is the design and maintenance of pressure seals between a rotating and a fixed surface in these rugged conditions, especially at higher pressures.

Furthermore, it has been well documented in the oil and gas, environmental, pipeline, utility and water jetting industries that rocks, cements and other natural and manmade materials can be efficiently drilled, cut and/or fragmented at an enhanced rate utilizing high pressure, high velocity fluids. Drilling rate improvements using this technique are directly related to the material's destructibility/compressive strength, fluid density and compressibility, fluid flow rate and applied pressures. Typically a "threshold" pressure of the material must be exceeded before any benefit of this technique can be realized. However, no method is available utilizing technology of the contemporary art to efficiently transmitted high pressure fluids through the contemporary motor section to be delivered at the drill utensil/bit tip as it is rotating.

Another well-documented method in the oil and gas, environmental, pipeline, utility and water jetting industries to enhance the drilling and cutting process of many materials is "abrasive jetting". This process utilizes the addition of solids (sands, fine ground rock, metal spheres) to a high pressure, high velocity carrying fluid to enhance the cutting process. Again, no mechanism in the contemporary art has been developed to allow use of this advanced drilling technique without the full high-pressure fluid/solid stream passing through the internal motor section(s).

Contemporary downhole hydraulic motors can only be put in positional series, increasing power (torque and horsepower) with the flow path of the power fluid only in series, i.e. with power fluid exiting one motor then entering as the high pressure into the next motor/motor stage. In this configuration, all motors/motor stages in series turn in the same shaft in the same direction and at the same rotational speed. Thus no motor can work independently of the others. Also, no current design of downhole motors allows power fluid to fully bypass the motor section to obtain higher rates or high-pressured (greater than 5,000 psig) hydraulic fluid at the utensil/tool/bit tip for other uses, such as running other motors in series, hydraulic and abrasive jetting ahead of the bit. Consequently, high pressure hydraulic jetting, abrasive jetting and the bypassing of fluids to the bit tip or other drilling utensils and flexibility in operating motors in series are all needs of downhole drilling motors that are not available via the contemporary art.

Furthermore, no instrumentation can be installed below the motor section, i.e. between the motor and bit, that has hydraulic or electrical communication through the motor section in the contemporary art. This is due to the disruption of the hydraulic flow path by the motor and the rotating shaft/bit. This limitation forces all such instrumentation to be above the motor and therefore 30 to 90 feet above/behind the lead bit or drilling utensil. Such near-bit instrumentation is important to maintain heading and direction, dip, measure pressure, rock types and fluid types in the just drilled rock. Sensing this information as near the bit as possible is important for efficient drilling operations.

The same limitations listed immediately above can be said about electrical motors below the initial motor section with limitations on getting the power/communication past the top motor to the subsequent, lower electrical motors. Electric motors for downhole drilling use are not utilized in contemporary art due to limitations on cooling of the motor components and getting fluid flow to the bit/drilling utensil for cooling, lubrication and bit/hole cleaning. By resolving these problems with electric motors, such motors may be utilized more frequently.

Additionally, drill rates with conventional methods can be limited by the torque limits of the tubular string and connections. This limit dictates the size, grade of the materials and the connection type used for the drill string. By limiting the torque transmitted from the drilling process to the drilling string above the motor(s), lower grade materials, connection types and string diameters may be used. There are no means to provide such balancing or reduction of the transmitted torque using conventional techniques, without reduced drilling effectiveness of the drilling process.

Enlargement of existing holes is common within the pipeline, utility and oil and gas industries. The need to drill an enlarged hole, greater than an uphole restriction that the bit/motor must pass through, is becoming more important as the industry pushes for smaller hole sizes and fewer casing string. If the hole above the desired drill point is larger than the desired hole size, conventional methods can be used. These include making additional 'trips' to take off the smaller bit and install the larger, desired bit. If the pipe is jointed and rotated from the surface, a larger 'reaming' bit behind the smaller lead bit can be used for concurrent drilling and reaming. With either jointed or continuous drill pipe, contemporary bi-centered bits can be used to drill a larger hole than the bit has passed through uphole. This one-pass hole enlargement using a singular bi-centered bit can be done with contemporary downhole motors or with rotation from the surface. Contemporary downhole motors cannot utilize separate and independent bits to concurrently drill and ream a given hole in a single pass—absent the use of a bi-centered bit.

Lastly, new advanced techniques to improve the drilling process are being developed using laser and or plasma energies applied to the materials to be 'drilled' or removed just ahead of the bit/drill utensil. The problem of such processes include getting power from the laser/plasma tool to ahead of the bit and/or through the motor section(s) and in keeping the wellbore hole clean of "drilled" materials. No current method exists to use a downhole motor and/or vibrator immediately above/behind the "bit" with these new processes to breakup the just cooled and solidified displaced drilled materials. No current method exists to apply a cooling fluid directly ahead of the bit/drilling utensil tip, after thermal spalling/melting/vaporizing, to cool and re-solidify the "drilled" materials for break-up and removal out of the wellbore. In addition, any method that allows cooling and breakup of these displaced "drilled" materials will further advance these and similar processes.

A hydraulic motor(s) was proposed in referenced U.S. Pat. No. 5,518,379, by Harris and Sussman, that claimed central passage of pressured fluids through a rotating "tubular rotor having an interior motive fluid flow channel . . . extending along the length of the rotor". Quite distinguishable from the instant invention, the '379' patent requires dual motors in series and utilizes the interior flow channel only for operations of these motors. The only claim made of the internal shaft channel was to allow the operation of the hydraulic motors in series. It is important to note that the '379' motor designs and all motor designs found of the contemporary art, the center shaft rotates relative to the base. Since it is difficult to have sturdy high-pressure (5000 psi and higher) seal connections across the rotating shaft-non-rotating base junction, operating pressures must be restricted. Within material limits, the higher the available, effective pressure differential pressure across a motor section the higher the torque output that would be available. Thus, if higher pressures can be utilized across the motor section, for the same torque rating the motor can be shorter in length. Higher pressures within and through the motor to the drill utensils are also limited by these motor seal designs and capabilities.

Increasing temperatures also reduce the available useable pressure, due to reduced materials' strengths. Most contemporary downhole motors are limited to about 315 degrees Fahrenheit due to required material selections. The industry is constantly pushing to drill deeper where temperatures can exceed 400 degree Fahrenheit, well beyond the capabilities of all but a few motors. Thus with lower seal requirements and proper selection of materials, higher operating temperatures can be allowed. An all stainless steel or equivalent metal motor would have the ultimate temperature potential.

The industry(s) is also pushing new power fluids that are lighter, heavier or non-damaging to the drilled formation(s). Such special fluids can also be used to help cleanout old or re-entered wells, pipes and pipelines of scale, paraffin, cements or other solids. These new fluids include nitrogen, carbon dioxide (liquid and/or gas), solvents, acids (acetic, hydrochloric, formic) and bases. Most contemporary motors, except special designs of the '379' motor, cannot utilize the full range of fluids that the industry has available for use. A downhole motor that can utilize the full range of these fluids as a power fluid, through internal design or materials selection (in particular an all metal design), can gain a wider acceptance and use in the industry.

Consequently, to remedy deficiencies associated with downhole motors of the contemporary art, there exists the following needs that serve as objects of the instant invention and to which the instant invention addresses itself:

One object of the instant invention is the need for a downhole motor that can deliver high torque in a short length to allow drilling highly deviated/directional/curved holes.

Yet another object of the instant invention is a downhole motor that is insensitive to fluid types due to an all-metal, or selective material design.

An additional object of the instant invention is a downhole motor that can operate at higher pressures (differential and/or internal operating) and temperatures.

Another object of the instant invention is a downhole motor that allows for all or a portion of the fluid flow to bypass the motor section for bit/motor/bearing/rock cooling, bit cleaning, wellbore hole cleaning, near-bit instrumentation monitoring and powering of near-bit motors in series, vibrators, sonic devices and other devices in lower positional series to an upper/top/first motor.

Another object of the instant invention is a downhole motor that allows for electrical lines/wires to go through a motor section(s) for near-bit instrumentation sensing monitoring and powering of nearer-bit electrical motors in series, electrical vibrators, sonic devices and other electrical devices in lower positional series to an upper/top/first motor.

A further object of the instant invention is a downhole motor that will allow for high pressure fluids to be transmitted through the motor and utilized at the drilling utensil/bit tip for hydraulic jetting, abrasive jetting and/or for operating motors in series.

An additional object of the instant invention is to provide an integration of motor housing and tool functions that can shorten the overall length of the drilling assembly.

A next object is the ability to drill a larger hole than the size bit selected or drill a larger hole than the bit/motor earlier past through (i.e. through an up hole restriction).

Another object is the ability to allow lower drill string requirements, including lower torque and strength capabilities, and smaller pipe diameters.

Lastly, an object of the instant invention is to allow pressurized fluid flow to cool but not contaminate an electric motor suitable for drilling applications and to provide cuttings cleaning at the bit tip and in the wellbore while utilizing such an electric motor.

It is intended to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

In this respect, before explaining at least one embodiment of the invention in detail, it is to be understood that the invention is not limited in this application to the details of construction and to the arrangement so the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Further, the purpose of the foregoing abstract is to enable the U.S. Patent and Trademark Office and the public generally, and especially the design engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Additional objects and advantages of the invention are set forth, in part, in the description which follows and, in part, will be apparent to one of ordinary skill in the art from the description and/or from the practice of the invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference would be had to the accompanying drawings, depictions and descriptive matter in which there is illustrated preferred embodiments and results of the invention.

BRIEF SUMMARY OF THE INVENTION

Responsive to the foregoing challenges, Applicant has developed an inverted motor for use in drilling operations that reverses the standard roles of the non-rotating fixed housing and rotating internal shaft components of contemporary motors wherein now the shaft of the inverted motor is now affixed to its base and does not rotate relative to the base. With the new invention, the motor housing now rotates around the shaft and is powered by an internal motor (i.e. rotor-stator combination), in the void between the housing and shaft, and a drilling utensil, typically though not limitedly, a tool bit is optimally attached to the end or on the side of the motor housing, or integrally associated therewith. Therefore, the instant invention is comprised of—a base that is attached to a hollow tubular drill string that can be rotated; a non-rotatable (relative to the base) shaft or tube attached to, part of or integrated into the said base; a rotatable (relative to the base) housing; at least one motor cavity formed between the rotatable housing and the non-rotatable shaft; a radial or rotary motor (rotor-stator combination) of any number of types and styles within said motor cavity; and a drilling utensil of any number of types and styles that is attached to, part of or integrated into the said motor housing.

As protected in an embodiment of the instant invention, the motor's hollow tube/shaft is securely fixed to or is an integral part of the base and does not rotate relative to the base. The motor housing rotates around the shaft or tube, relative to the base, being powered by a rotary motor (rotor-stator combination) in the cavity formed between the housing and shaft. The rotary motor of the instant invention can be of any activation type (hydraulic, pneumatic, electric) and style (electric, turbine, positive displacement-moineau, gerotor, roller vane, vane, wing, piston, etc . . .) and utilize any of the conventional (water, oil, air, nitrogen, foamed mixtures and others) and unconventional (acids, bases, carbon dioxide liquid/gas and others) fluids for powering the motor and for cleaning and cooling the downhole apparatus. A drilling utensil/bit is attached to the end and/or side of the motor housing by thread connections or can be made/machined/manufactured as an integral part of the motor housing. The design and selection of the type of materials for the drilling utensil/tool/bit is particular to the specific application (rock, solids, depth, pressure, temperature, hole size) and are well known in the oil and gas, utility, environmental and pipeline industries.

The non-rotating shaft or tube extends from the base and can be fully recessed inside the motor housing, or can reach to the end of the motor housing/tool/bit, or can extend past or beyond the end of the drilling utensil/bit, depending on the application desired. The motor shaft/tube can also reattach to a new lower section of the tubular drilling string allowing the motor (with rotating housing and tool) to reside at any location along the tubular drill string—i.e. this new motor does not need to be near the end bit assembly. Also, as a general design for strength and durability, the shaft should be as large in diameter and as short in length as possible for the motor requirements and application desired. Both the base above the motor and the shaft/tube extending past/beyond the drilling utensil can be bent or angled. In addition, several options exists for appliances at the forward end section of the shaft—a oriented nozzle can be installed at or near the end of the shaft; another inverted motor can be attached for motors in positional series; or a conventional motor can be attached to the extended shaft. All such additions allow for enhanced drilling, hole enlargement, and directional/oriented drilling.

One or more essentially oval channels exist inside both the base and non-rotating shaft/tube and the said channels can extend the full length of the shaft/tube. Ports can exist at both ends of the shaft and side ports can be installed at any position along the shaft for high pressure fluid entrance into the motor section(s) or side jetting. The bit-end port and all motor inlet ports (in the base or shaft/tube) can be nozzled or restricted to maintain a back pressure in the internal shaft channel and control flow rate. The design (size and material requirements) of these nozzled ports for specified rates and pressures is well known in the industry. Such nozzles may be oriented in any direction desired for the application. For example, the bit-end nozzle on the shaft/tube may be oriented 30 degrees off axis (non-axial, non-centered) ahead of or behind the bit to aid in the drilling and blasting of rock and other solid deposits (such as scale, paraffin and other solids) that can exist in tubular strings (wellbores, pipelines, pipes). A rotating nozzle may also be used to impact a wider area. Alternately, such a directed nozzle can be used to aid in the directional drilling of materials ahead of the bit(s), where selected portions of the rock materials are removed for easier drilling in that given direction. In addition to fluid flow, the internal channel(s) through the base-shaft/tube can contain electrical or optical cables or wires for bypassing a given motor section or stage allowing transmission of electrical or optical power or signals. Such wiring/cabling allows for Logging-While-Drilling (LWD) or Measurement-While-Drilling (MWD).

The high-pressured power fluid is pumped from the surface, down the tubular string to the top of the base. The flow can then split with one portion going into and through the motor shaft and out the bit/drilling utensil end. If required by the motor design, the other portion can go through other channels in the base into the motor (rotor-stator) section that is between the shaft and housing, to power/operate the motor. Alternately, based on the motor design selected, all power fluid to operate the motor may first go into the shaft's central channel and then selectively out designated motor ports along the shaft's length to enter the motor sections at specified points. For motors or motor stages in positional series, after the power fluid transverses a motor section, the depleted power fluid can follow either a sequential or a parallel flow path. The sequential fluid flow path allows the depleted power fluid from an earlier positional series motor segment/motor stage to flow into a subsequent motor/motor stage as the new inlet high-pressure power fluid that can then be repeated for multiple motors/motor stages in series. The parallel fluid flow path allows the depleted power fluid from the earlier positional series motor/motor stage to be directed out the motor section into the drill utensil/bit section to clean the bit or directly outside of the motor housing into the newly cut hole. Motors or motor stages that have a common, inlet high-pressure source (e.g. from the internal shaft channel or base inlet) are considered having parallel flow paths to each other. It should be noted here that bearing assemblies for thirst (axial) and journal (side) forces on the rotating housing/drilling utensil/bit are required at the base and near the end of the shaft. Only seals internal to and at both ends of the motor are required and these seal requirements can be minimized by motor design. Bearing design is also subject to motor design and requirements.

Also, with the proper design of hydraulic and pneumatic inverted motors, such motors can be put in positional series with a common inlet of high-pressure fluids (i.e. parallel flow paths), but with exit points on opposite ends of the overall motor section. The exit port of such opposing motors could be to the outside of the housing or toward the bit for cleaning and cooling. The number and design of stages on each end as well as the placement of restrictions/nozzles at the entrance and/or exits ports of the motor section can allow selective flow rate and back pressure to develop to aid in balancing generated axial forces. This opposing motor placement allows balancing of the internal axial forces onto the common motor housing and/or shaft for reduced thrust bearing requirements; and, if each motor side has multiple stages, the seal on each end can be designed for minimal pressures since it will encounter only lower/expended/depleted pressurized fluids. In addition, such opposing motors may also be designed to partially offset the induced axial/thrust forces required by the external drilling process, primarily known as 'weight on bit'. This can be accomplished by off balancing the internal exiting pressures in the opposing motors to counteract all or a portion of this external force (pressure difference X effective acting area=force).

The nozzle at the bit end of the shaft may be angled off the center axis to allow directional jetting (hydraulic or abrasive). This action would allow a preferred direction of drilling as the jetting would precut a portion of the rock allowing easier drilling by the subsequent drill utensil/bit. Alternately, the bit end nozzle may be rotated with the drilling utensil using current jetting technology to allow a wider/broader jetting cut ahead of the bit. The addition of solids to the jetting stream, called "abrasive jetting", would also be possible since the solids have a flow path that does not require going through the motor section, e.g. as through an electric motor. Separation, straining or filtering of the mixed power fluid downhole could allow hydraulic or pneumatic motors to be used with abrasive jetting.

It should be noted that for Inverted Motors as for conventional motors, rotation in either direction (clockwise or counter clockwise) is possible. Only with Inverted Motors can this advantage be fully utilized. With Inverted Motors placed in positional series, a combination of these rotational directions may be preferred to balance the overall reactive torque generated by the drilling process. By attaching smaller and smaller bits and motors to the non-rotating shaft of the immediate up-hole Inverted Motor, and each bit size (cutting surface) properly sized and directionally rotated as needed, this torque balancing can be accomplished. Such a unique motor series design of the instant invention with motors in positional series allows each bit/motor combination to rotate opposite each other, theoretically allowing the overall reactive torque from the drilling process to be canceled or balanced out. The described staging in bit/motor sizes is not fully required, as drilling tools of the same size as the forward bit can be utilized to clean the hole and move the pipe forward at the same time as balancing out reactive torque. Multiple series of these bit/motor combinations would allow better statistical balancing of these forces and allow smaller and weaker drill string designs. Thus smaller, lesser expensive drill strings can be used.

All Inverted Motor designs of the instant invention allow concurrent hole enlargement via three (3) methods—motor driven concurrent reaming with a larger bit and motor above or following a smaller lead bit and motor; eccentric (off center) bit design where the drilling utensil is built larger on one side of the motor housing than on the opposite side; and/or use of an eccentric internal motor designs, where orbital or eccentric motor types are chosen to enhance this off center drilling feature. With the instant invention no rotation from the surface is required for hole enlargement. This is because true concentric drilling is now possible—a smaller motor and attached bit is installed on the extended fixed shaft of a (possibly larger) motor and larger bit. Each motor independently operates its own housing-attached bit, thereby not causing increased speed/rpm problems. Existing art cannot run multiple motors in independent series, each with separate drill utensils.

The second ($2^{nd}$) method of hole enlargement with the instant invention can be accomplished by building the drilling utensil/bit/cutting surface thicker on one side of the motor housing and thinner on the other side, such that the net path of the furthest cutting surface from the true center is larger that the actual diameter of the bit and motor. Using a series of these offset/off-center bit designs and concentric Inverted Motors, the hole size can be progressively enlarged and the overall net reactive torque on the drill string above the motor(s) can still be balanced.

The third ($3^{rd}$) method of hole enlargement using an inverted motor design is by choosing a motor design that is eccentric, i.e. not concentric, where the housing with attached drilling utensil/bit rotates and gyrates off center to the axial center of the drill string and drilled hole. The Inverted Moineau and Gerotor motor designs, in particular, can generate this eccentric housing/bit movement and, again, with such motors/bits combinations in series, progressive enlargement and balanced torques can be obtained. The amount of eccentricity in the motor/bit can be controlled by the design of the amplitude of and number of the lobes in each case.

Hydraulic and pneumatic motors of all kinds can provide non-linear, non-constant torque, speed and power output through a full rotation cycle. This limitation can sometimes cause or encourage "stalling", where the tool and motor stops rotating. To provide smoother torque, speed and horsepower output to the drilling utensil(s), more than one inverted motor or motor stage can be put in positional series (using either parallel or series power fluid flow paths) with some specified angular offset to each other. This angular offset is specific to the motor type selected and utilized. Angular offsetting such motor sections or stages for smoother power output is well discussed in industry publications.

If the selected inverted motor type is electric, the full fluid flow from the internal base will go into the shaft/tube internal channel(s) to cool the motor and bearings, operate any instrumentation (hydraulic or electric) and to clean/cool the bit at the tip and clean the wellbore of cuttings. No fluid will enter the motor section via the base or shaft. Especially for electric versions of Inverted Motors, but true for all Inverted Motor designs, electric wires or optical cables can extend through the internal shaft/tube channel(s) and can be concurrent with the fluid flow or in a separate internal channel—both paths allowing full bypass of the wires, cables and fluids of any given motor section or stage. This allows additional motors, instruments and tools to be in positional series closer to the bit tip than the original/first/upstream motor.

A hydraulic/pneumatic gerotor motor of the concentric type is used for purposes of disclosure as a non-limiting instant invention to an existing motor design to simplify a complex design and utilize it for use in drilling and cleanout of wells and pipes of rocks, soils, cements and other materials, including man-made materials. Note that a similar conversion of Moineau motors, currently used in the industry, into an inverted concentric design of the instant invention is also envisioned, possible and planned. In existing gerotors used today, cardan shafts and other devices are required to regulate flow. While these type motors are efficient, with long life characteristics, these cardan shafts and other devices are the weakest link in the motor's power system. They also follow the typical design of the fixed motor base and housing with a rotating internal shaft that extends out the motor housing end for tools to be attached. In many/most current designs, the flow direction must be reversed for proper valving operation with the inlet and outlet on the same end of the motor.

However, in the provided example, the instant invention improves upon the existing gerotor motor design such that the shaft is now fixed to the base and the housing rotates. Valving is now accomplished by the internal rotating ring. The tubular string's base is a 'sub', short section the same diameter as the round string, but not necessarily of the same material. It can be straight or bent as now possible and utilized in the industry for directional drilling. It is solid with any required threading on the inlet end to match up with the tubular string and has a central channel that intersects the center of its outlet side. Four (4) equally spaced (from each other and equally distanced from the center) port channels are drilled at an angle from the outlet side of the base to intersect the center channel at some distance from the outlet side. The drilled angle required for these channels is a function of the shaft diameter relative to the base diameter. At the exit point of each angled channel, a larger 'inlet' port is carefully and selectively machined to allow flow across a larger exit area with a specified shape. The base also has a reduced diameter section with indentions, as required, at it's outlet end that allows the motor housing to overlap and provide inclusion of thrust and journal bearings/surfaces for support of the motor and drilling operation. This same section could also include a latch and a pressure seal. The face of the outlet end of the base must be highly polished smooth to allow the rotation of the ring next to the shaft and inlet ports. As fluid enters the base it is split into 2 portions—one portion goes into the central shaft channel, through the shaft and out the end of the shaft. This portion of the total fluid flow bypasses the motor section completely and it can be plugged or nozzled to control or limit the portion of the flow going this path. The other fluid flow portion enters the motor cavity through the inlet ports on the face of the base. This flow portion can also be regulated by use of nozzles or restrictions at the inlet. The theory and design of nozzles and chokes to regulate fluid flow in the oil and gas, pipeline, utility, environmental and water jet industries are well known.

A fluted/lobed and hollow rotor/shaft is attached to the center of the outlet side of the base or is machined with it to be an integral part of the base. If separate, it must have matching threaded pins (rotor) and box (base) ends suited for the pressure requirements. For pressures above roughly 8,000 psi, special-thread designs and metal-to-metal seals should be used. It is envisioned, but not required, that this type motor can be operated at pressures approaching 15,000 psi, or even higher, on the inlet side of the base. The shaft can extend to, beyond or short of the tool/bit end depending on the application requirements. By general design the shaft must have the largest diameter and the shortest length possible for durability and strength since it is a key component of the motor. The drilled central hole in the shaft or tube is sized for the fluid flow and shaft strength requirements.

The design of the shaft lobes must also be consistent with standard gerotor design principles-most notable that the center element's lobe count is one less than the outer element's cavities and the opposing sides must form a seal as the elements move. Any reasonable number of lobes and shape of those lobes on the shaft is possible, allowing for differing characteristics of the motor-torque, displacement, gyration amplitude, maximum pressure, ability to handle solids and others. In the example given a four (4) lobed shaft and a five (5) cavity/valley ring is utilized. It is important that the inlet and outlet ports be exactly positioned relative to the fixed lobes on the shaft for the motor to operate. The number of ports (input/inlet and exhaust/outlet) each matches the number of lobes on the shaft.

The outlet end of the shaft must have a reduced diameter, threaded section to allow the exhaust/discharge disc and a bearing assembly, here called a bearing disc, to be installed. A nut (which can also include a nozzle or plug to direct or regulate the flow from the internal central channel) serves to hold the bearing disc in place to provide thrust support for the motor assembly. Threaded holes must be drilled into the flat ends of the lobes to allow bolts to help hold the motor assembly together during operation and to ensure proper alignment of the discharge ports on the discharge/exhaust disc.

An outlet/discharge disc is pressed or threaded onto the reduced neck of the shaft to fit flush to the end of the lobed portion of the shaft. The disc has four ports machined through it at an equal distance from the center to match the inlet ports. These exhaust ports must be exactly positioned, sized and shaped and may be different from the inlet ports. The exhaust ports are angularly rotated from the inlet port positions by 45 degrees. This allows an alternating sequence of ports to be opened and closed for each motor cavity as the ring rotates. The discharge disc, 4 bolts, shaft threads, bearing disc and nut all hold the hydraulic power fluid's pressure in the motor cavity for maximum operation efficiency. Both sides of the disc must be highly polished to allow minimum friction during rotation of the motor ring against the base and discharge disc.

Following standard hydraulic motor and pump principles of the Gerotor designs, the cylindrical ring is a five (5) lobed "stator" to match the four (4) lobed shaft "rotor". In this case, the motor ring rotates and gyrates around the shaft as the pressurized fluids expand the exposed motor cavity and force movement. The outer diameter of the motor ring is limited to the internal diameter of the housing. Both flat ends of the motor ring must be highly polished to ensure a seal although some leakage is anticipated and desired for lubrication, cooling and to prevent 'hydraulic locking' (the temporary condition when no inlet or exit ports are exposed and the fluid is non-compressible). The pressures desired in the motor cavity, the shaft diameter, the number and eccentricity of the lobes/cavities, and the internal diameter of the housing all set the external diameter of the motor ring.

As the motor ring rotates and gyrates around the shaft, it gyrates off center and its internal edges alternately opens (exposes) and closes (covers) both inlet (on the base) and outlet (on the discharge/exhaust disc) ports. Expansion occurs in two (2) adjacent motor cavities while exposed to inlet ports, and, concurrently, two (2) opposite motor cavities contract while exposed to exhaust ports. The rotating and gyrating motor ring alternately covers and uncovers the desired ports during this rotation/gyration movement. While the inlet power port is exposed to a given motor cavity between the shaft and motor ring, pressurized fluids enter that motor cavity and expand it, causing the motor ring to rotate around the shaft. While the exhaust port is exposed to a given motor cavity, power fluid escapes through the port and through the discharge disc and bearing disc and out the motor housing. As one set of cavities expand and adjacent cavities contract, the ring is rotated resulting in a force and rotation that is transmitted to the housing which thereby turns the tool.

Two holes are drilled into the side of the ring in one axial line but do not penetrate into the inner motor cavity. These holes are used to ensure a hold down position of the housing onto the motor assembly and to transmit the torque and rotation from the ring to the housing. Alternately, torque and rotation transmission between these 2 motor elements can be accomplished by coarse gears, splines, stops (with springs or needle bearings), or more loose/flexible pins around the full circumference.

The bearing disc is a bearing element that provides thrust and journal bearing surfaces for both the motor and drilling operation. The thrust forces from the drilling and motor operations can be shared by the bearing disc and housing-base bearing assemblies. These bearings elements can be provided by ball bearings, needle/roller bearings or a Teflon, metal-metal, or solid type material coating. Bearing designs and coating materials are already well known in the industry. Slots cut on the outer edge of the discharge disc allow fluids leaked or directed out of the motor into the ring-housing cavity to escape out the bit end of the motor housing.

The rotating housing of the motor contains the tool/bit of choice and contacts the non-rotating base at the housing-base bearing and contacts the shaft at the bearing disc. The housing has ports on its outlet end that allow flow from the shaft channel, motor exhaust and motor leak bypass. Its internal surface is smooth with holes drilled and threaded for connecting pins to the rotating ring. Alternately, internal spline gears, stops/slots and/or ridges can be installed for higher torque applications, but these must match the motor ring's outer surface.

Variations in this basic design can be made to allow this motor to be put into positional series, with or without angular offsetting to smooth out power output to the drilling utensil and with either series or parallel fluid flow paths. A general pattern for use in positional series motors is where both inlet and outlet ports are installed in the same common base or common disc (i.e. both input and exhaust) with distinct internal channels for each function directing the fluid flow. This common disc must be screwed or pressed onto the central shaft for sealing and alignment. A variation in this general pattern for series fluid flow paths is where the outlet/exhaust ports of one motor/motor stage becomes the inlet port for the next motor/motor stage in positional series to the first motor/motor stage all with the same (discharge/inlet) disc. This common disc design also allows the angular rotation of the subsequent motor/motor stage relative to the immediate upstream motor/motor stage for overall smoother power generation. This angular offset is accomplished by directionally machining the internal common disc channels such that the exhaust port on one side/face of the disc is offset some angular rotation from the inlet port on the other side/face of the disc.

Another variation in this general pattern is possible for parallel fluid flow using the common disc design. In this variation it should be fully noted that the inlet flow path does not have to come through the base face, since all power fluid can be diverted into the central shaft/tube channel and distributed further down the shaft length. For non-base sourced fluid input, inlet ports can be drilled at any point along the length of the shaft for fluid to exit the shaft's internal channel and be diverted via an common or input disc into a motor cavity. High pressure fluids from the shaft channel, through drilled and nozzled ports in the shaft, enters a common/inlet disc's high pressure internal channels and is directed to inlet ports on the disc's face into the desired motor cavity. Exhaust fluids from the upstream motor can travel through the exhaust ports and internal channels in the common/exhaust disc and can be diverted into the subsequent motor's cavity between the ring and the housing or out of the motor into the newly drilled hole. This can be repeated as often as desired and with any angular rotation of subsequent motors/motor stages. It should be also noted that a combination of parallel and series flow paths can be utilized for motor or motor stages in positional series utilizing the Inverted Motor designs.

Most eccentric style motors, such as Gerotor and Moineau styles, in an inverted design can be made into a concentric style Inverted Motor by using this coupled ring-housing method to transmit torque and rotation to the concentric outer housing and bit. However, such a concentric conversion reduces the allowable diameter of the shaft and power sections. Direct (i.e. non converted) use of eccentric style Inverted Motors for drilling, where the ring is also the housing and the tool is attached to or part of the ring's outer diameter, is possible and sometimes desired. In particular, eccentric designs can be useful for hole enlargement, improved hole cleaning and pipe movement.

DETAILED DESCRIPTION OF A PREFERRED EMBODIMENT

Figure 1:
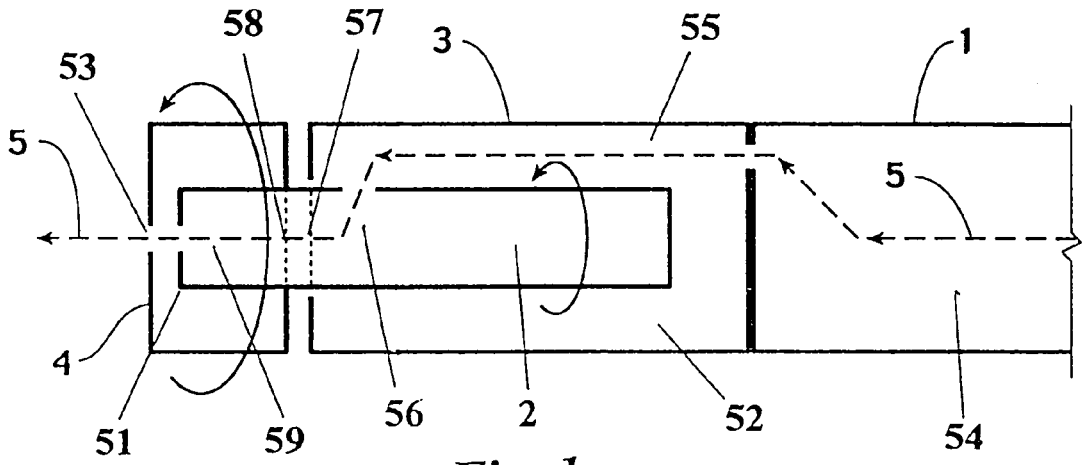
FIG. 1 is a simplified longitudinal cross-sectional drawing of a typical motor used in the contemporary art.

FIG. 1 is a simplified longitudinal cross-section drawing of a typical motor currently used in the contemporary art. In this illustration, a motor housing 3 is affixed to and does not move relative to a motor base 1. Said motor base 1 is attached to a hollow tubular drill string. A rotary motor 52 is positioned between said fixed motor housing 3 and a free floating motor shaft 2, causing the shaft 2 to rotate whenever the motor 52 is actuated. A tool/bit 4 is attached to the shaft end 51 that extends out of motor housing 3 and rotates with the shaft 2. Fluid (liquid and/or gas) down flows along path 5 through the internal portion 54 of motor base 1, into a cavity 55 of the rotary motor located between the housing 3 and shaft 2, powering and transversing the motor 52, and crossing over into an interior portion 56 of the motor shaft 2, through a shaft center hole 57 and a tool bit flow channel 58, into a tool bit center hole 59 and exiting via a tool/bit-end opening 53.

Figure 2:
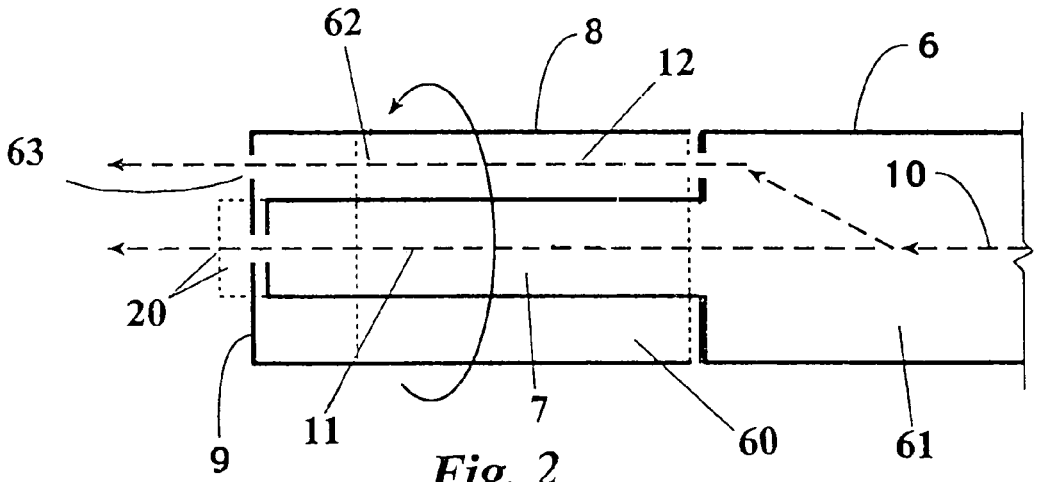
FIG. 2 is a simplified longitudinal cross-section drawing in one embodiment of the instant invention.

FIG. 2 illustrates a simplified longitudinal cross-section of a motor in accordance with one embodiment of the instant invention. This figure shows the basic elements of the instant invention, particularly—a rotatable (relative to the base 6) motor housing 8, a rotatable motor base 6 connected to a hollow tubular string on one end and a non-rotating (relative to said motor base 6) shaft or tube 7. The motor base 6 is shown as straight but it may also be bent for any number of applications. Between the motor housing 8 and shaft 7, one or more cavities are formed for positioning a rotary motor 60 of any number of types and styles. The rotary motor 60 is positioned between fixed shaft 7 and rotatable housing 8, causing the housing 8 to rotate whenever motor 60 is activated. A drilling utensil (drilling tool or bit) 9 is attached to, a part of, or integrated as part of motor housing 8, and thus rotates in concert with the rotating housing 8.

It should be obvious to those skilled in the art that many types of rotary motors would fit into this cavity to provide this power and motion, in particular, any number of hydraulic or pneumatic actuated motors; positive displacement, turbine or electric type motors; roller vane, vane or wing valved motors; and piston, moineau or gerotor type motors. It should also be clear that any number of these motor designs and types can cause the motor housing 8 to rotate in either direction, clockwise or counter-clockwise. Should the motor 60 be a hydraulic or pneumatic downhole motor, fluid 10 is down flowed through the internal portion 61 of tubular string base 6 with said flow dividing and entering both into cavity 12 of the motor 60 located between said housing 8 and shaft 7, as well as said fluid entering and traversing at least one essentially oval internal channel 11 of shaft 7, thereby bypassing motor section 60. Said internal channel 11 of shaft 7 can transverse the entire length of shaft 7, allowing exits on each end. The portion of the fluid down flow traversing the cavity 12 in motor 60, powers the motor and then exits the motor via one or more motor exiting orifices 62 located at one end of the motor 60, housing 8 and continuing exiting via one or more orifices in tool/bit 63. As fluid down flows through the internal channel 11 of shaft 7, it bypasses the motor/tool section completely and can be nozzled, plugged, or otherwise restricted at the end tip 20 of the shaft channel 11 to meet specified pressure and rate conditions. Note is taken that said end tip 20 of the shaft 7 can extend to, beyond or short of tool/bit end 9. A nozzle at the tip end 20 of shaft 7 can be oriented off center to aid in directional drilling efforts. If the motor 60 is not hydraulic or pneumatic, then the full fluid flow 5 is directed into and through internal channel 11 of shaft 7 where it fully bypasses the motor section and can be nozzled, oriented and or utilized to aid in the drilling effort.

Figure 3:
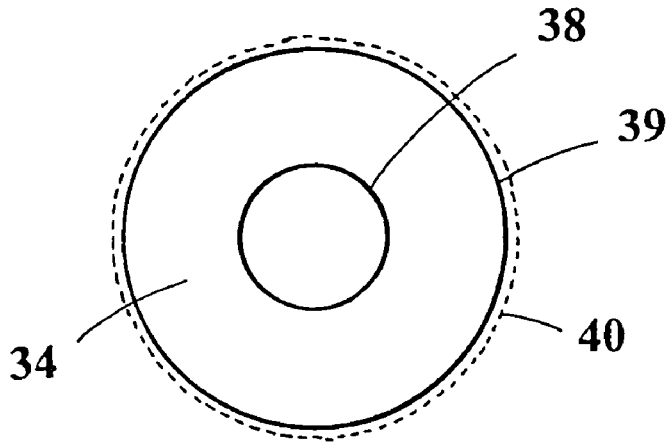
FIG. 3 is a simplified transverse cross-section drawing of a generalized concentric style motor of the instant invention.

FIG. 3 is a transverse illustration of a generalized concentric Inverted Motor design of the instant invention such that the outer housing edge 39 rotates centrally and concentrically around the fixed shaft 38 without gyrating or eccentric motion. The circle 40, extending from the shaft center to the outer edge of the motor housing 39, does not vary when the motor is in operation. According to this design, the attached bit or drilling utensil, if evenly placed around the diameter of housing 39, will cut a smooth and even hole around the center point. The internal motor 34 between the shaft 38 and housing 39 can be of multiple types and designs to accomplish this concentric rotation function.

Figure 4:
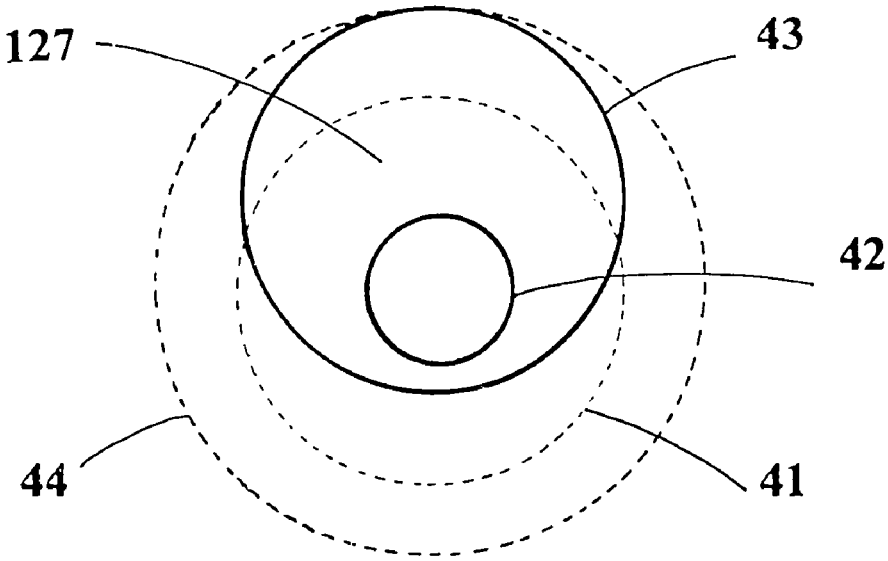
FIG. 4 is a simplified transverse cross-section drawing of a generalized eccentric style motor of the instant invention.

FIG. 4 is a transverse illustration of a generalized eccentric Inverted Motor design of the instant invention that allows the outer edge of the housing 43 to gyrate and rotate around the fixed central shaft 42 when the motor 127 is in operation. The degree of gyration and eccentric rotation of the housing 43 is set by the internal motor's type and design. Such a eccentric design would allow for drilling a hole 44 with larger diameter than the motor/drilling utensil would normally be able to drill and still pass through uphole sections 4.1 of a smaller diameter. Such a design would also allow for improved fluid flow, hole cleaning and pipe movement. The drawback to this style is greater vibration in the drill string and downhole apparatus.

Figure 5:
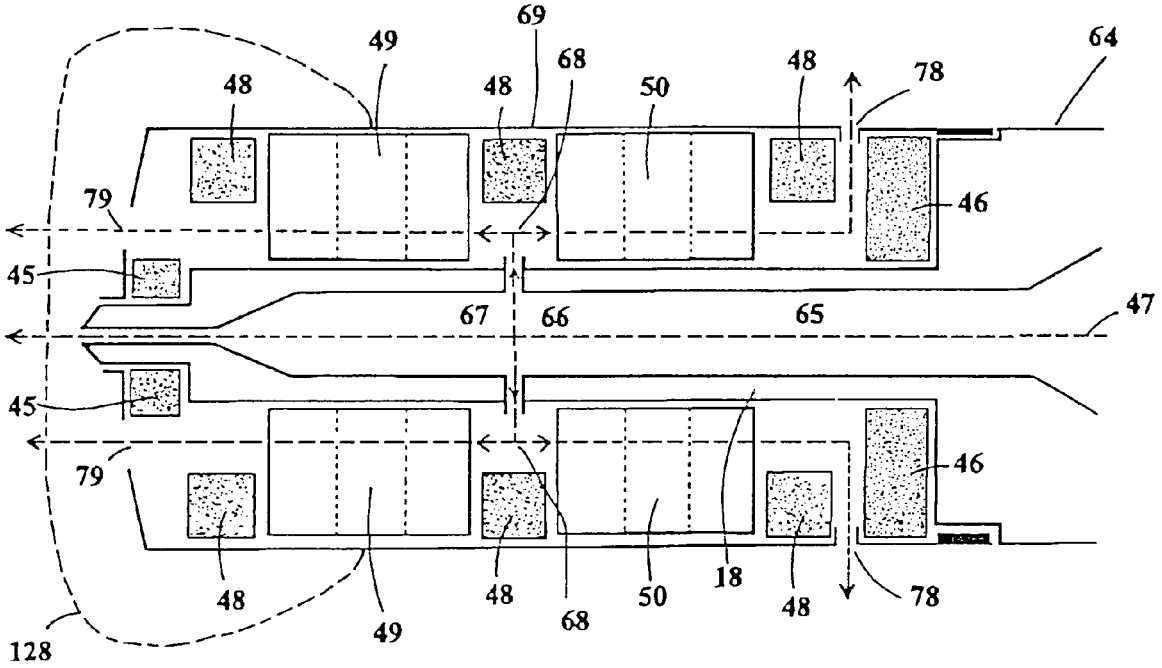
FIG. 5 is a simplified longitudinal drawing of opposing concentric motors (parallel to each other, but in stage series within motor) of the instant invention design for balanced axial internal forces.

The reader should note that in most hydraulic or pneumatic motors, as also possible in the instant invention, fluid flow progresses sequentially from one motor or motor stage into the next motor or motor stage. FIG. 5 is a simplified longitude drawing of generic hydraulic/pneumatic Inverted Motors of the instant invention, placed in positional series to the motor housing 69, but with the fluid flow paths parallel and in opposite directions allowing for a balanced axial internal force design. The opposing motors 49,50 rotate opposite each other, but power the housing 69 in the same rotational direction relative to the base 64. In this design, the full fluid flow 47 from the base 64 enters the internal flow channel 65 of shaft 18 to a junction 66 where high-pressure ports 67 through the shaft 18 allows high-pressure fluids into a common inlet 68 for the opposing motors 49,50. It should be noted here that said fluid flow's exiting point location from said internal channel 65 in shaft 18 can be variably positioned along the length of said shaft 18 and its internal channel 65. Fluid flow within each motor 49,50 and motor stage (sub sections of 49,50) moves axial away from the high-pressure inlet 68 toward the low-pressure exits 78,79, which can be selectively nozzled or restricted to control flow rates and/or create a specified back pressure within the shaft channel 65 and motors 49,50. Thus, the opposing motors 49,50 power the housing 69 and tool 128 in parallel and are in parallel flow paths to each other. Internal motor stages within each motor 49,50 are in series fluid flow paths.

With this basic opposing motor design of the instant invention, the number of stages motor count, internal motor design and back pressure of the opposing motors 49,50 do not have to be identical, which allows for variable internal axial force generation, thrust bearing design and seal design. Utilizing multiple stages within each motor, the available fluid pressure can be near or fully expended for the motor operation allowing the minimal net pressure at the ends of the motor section, i.e. at the low-pressure exit ports 78,79, thus requiring lower seal requirements. In this basic opposed motor internally balanced design of the instant invention, thrust bearings 45,46 can be designed for only minimal requirements of the drilling operation. In addition, this basic opposing motor design can be further extended to help balance the axial forces required for the drilling operation (the largest of most common of these induced forces is called "weight on bit") allowing further reductions in maximum thrust bearing 45,46 design. This is accomplished by further restricting exiting flows at ports 78 or 79, thereby increasing internal pressures on the selected end of the motor. This increased pressure off-balance can react onto the housing causing a net axial force to be generated—offsetting some of the induced forces caused and needed by the drilling process. Journal bearings 48 are utilized to counter side forces generated by the drilling and motor operations.

Furthermore, extending the concept of multiple motors from FIG. 5, it should be seen that many motors or motor stages can be arranged in positional series (irrespective of either parallel or sequential/series fluid flow) for power generation to the drilling utensil. Each motor or motor stage can be radially or angularly offset to the other motors or motor stages to allow more steady and consistent power generation through the full rotation cycle.

With multiple motors that can be rotated independently and in either direction, the net angular or radial force (torque) placed onto the hollow tubing string (i.e. reactive force from the rotating drilling operation) that is attached to the motor base can be minimized by proper design of—balancing the count of motors rotating in each direction, the drilling utensil size on each motor and each motor's rotating speed.

Figure 6:
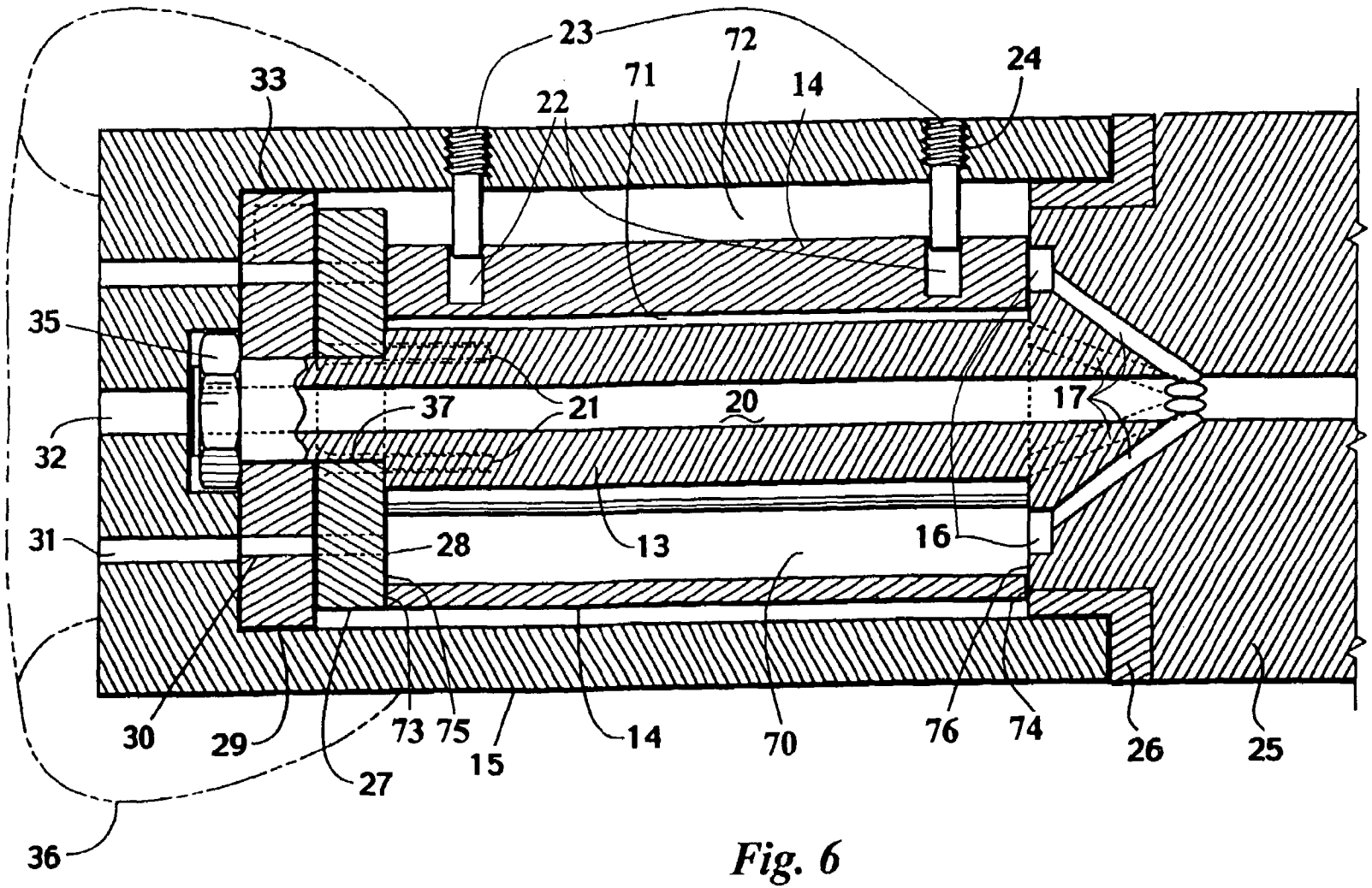
FIG. 6 is a longitude cross-sectional drawing of a concentric hydraulic/pneumatic positive displacement Gerotor motor according to the preferred embodiment of the instant invention.
Figures 6, 7:
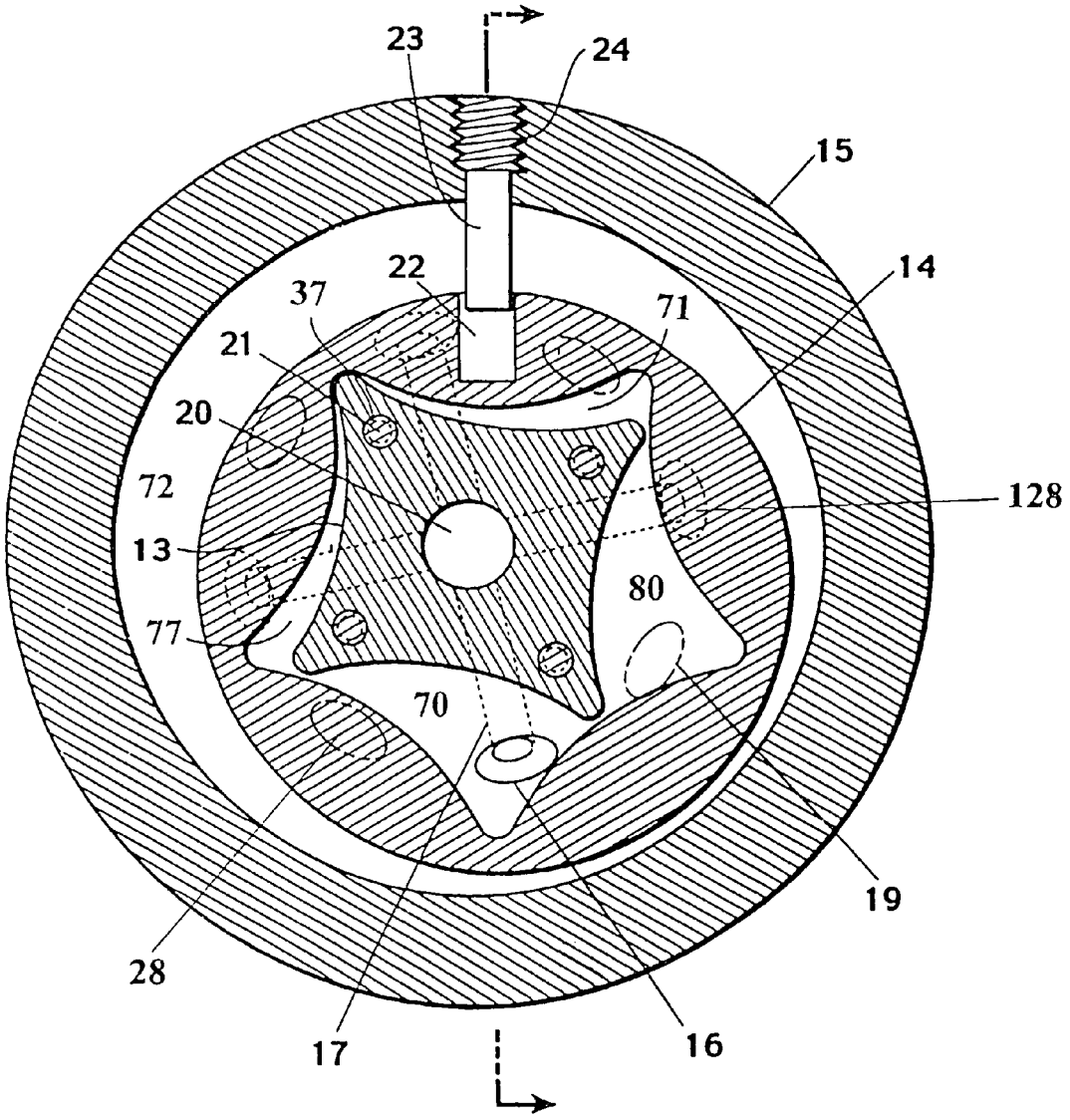
FIG. 7 is a transverse cross-sectional illustration of the hydraulic/pneumatic Gerotor motor following the instant invention shown in FIG. 6 as viewed toward the base.
Figure 8:
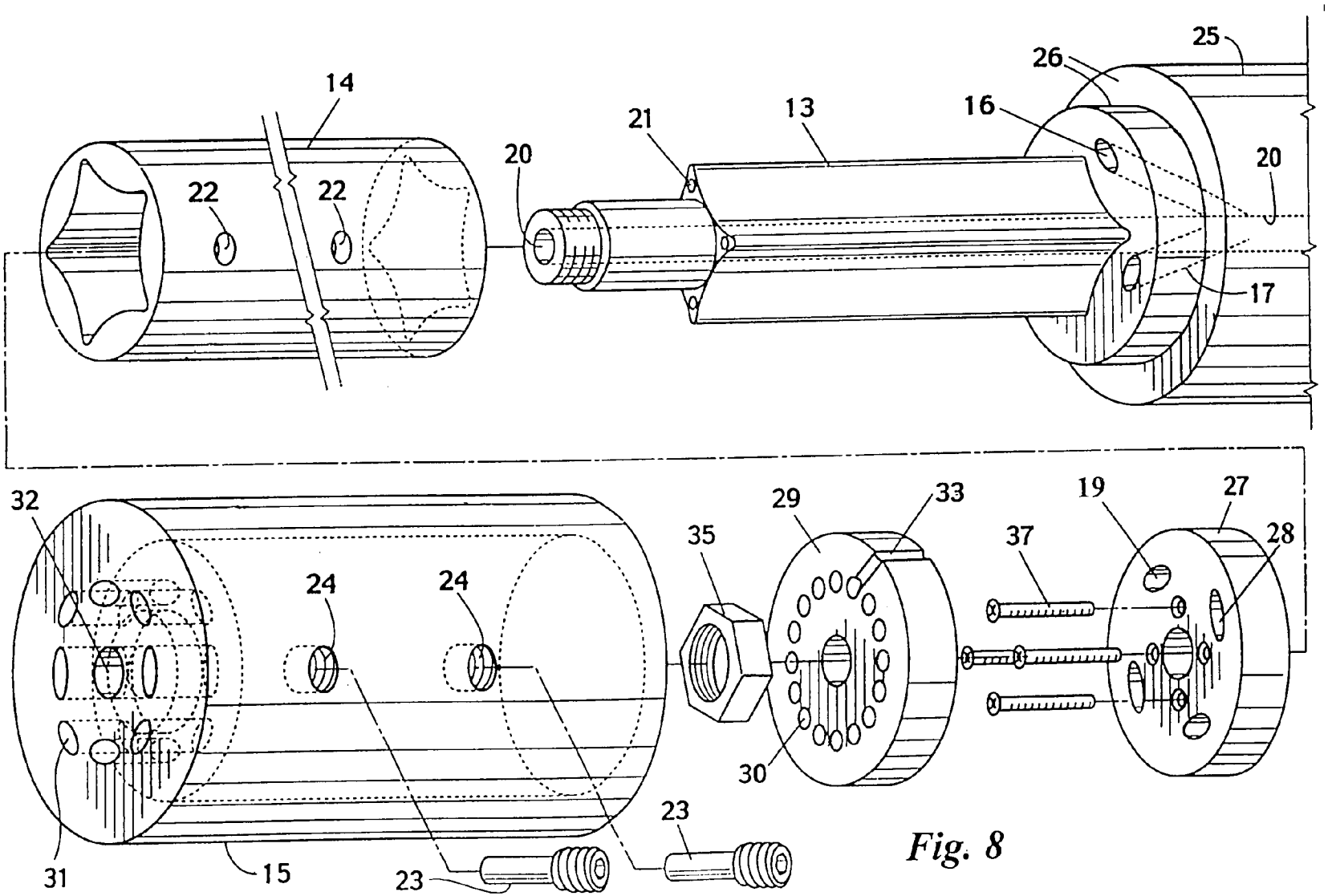
FIG. 8 is an exploded illustration of the Gerotor motor embodiment of the instant invention shown in FIGS. 6 and 7, that further details invention element positioning and interrelationships.

FIGS. 6 to 8 are drawings of a concentric hydraulic/pneumatic "Gerotor" motor according to the preferred embodiment of the instant invention, which provide enhanced detail and disclosure relating to the instant invention's elements structural relationships. FIG. 6 is a longitudinal illustration of the invention and shows the motor base 25 a/k/a "tubular string", motor section and the tool/bit end 36. FIG. 7 is a transverse cross-section in the middle of the motor section of FIG. 6 looking toward the base 25. Exhaust ports 19,28 are projected onto this cross-section to show their relationship to the inlet/entry power ports 16 and shaft/rotor lobes. FIG. 8 is an exploded view of the described invention showing details from the base 25 to the tool/bit 36 end.

As disclosed in FIGS. 6–8, the invention's base 25 is attached to a tubular hollow string that is lowered into the earth as the hole is drilled. Hydraulic or pneumatic fluid is pumped down the tubular string into the base channel 20, into the motor section through channels 17 and ports 16, into a motor cavity 70 to rotate ring 14 around shaft 13. A pin 23 connects ring 14 and motor housing 15, causing both to rotate in concert. A cutting surface, commonly referred to as "tool" or "bit" 36 is attached to or integrated as part of the end and/or sides of the motor housing 15 and thusly turns in concert with the motor housing 15. The rotating tool/bit 36 cuts the rock/material and the down flowed or pumped power fluid cleans cuttings from the face of the cutting surface 36 and lifts said cuttings upwardly outside of the motor housing 15 and tubular string 25 to the surface. The entire tubular string and motor can also be rotated for additional benefit, but is typically not required. In FIG. 6, the base 25 and lobed shaft 13 are shown as constructed or machined as one piece. As will be readily apparent to those skilled in the art, the lobed shaft 13 could be easily made separate from the base 25 via a threaded pin end and high-pressure seal to screw into a matched threaded receptacle in the base 25, an alternate embodiment of the invention. It must be ensured that the lobed shaft 13 is set to a specific position, relative to inlet ports 16. Both the shaft 13 and base 25 have a center flow channel 20 bored through to allow passage of high-pressured hydraulic or pneumatic power fluid. The base has a plurality of sub-channels 17 drilled and positioned to intersect with four matched motor entry or inlet ports 16 and the central channel 20. Sizing of these channels 17,20 is important to allow for minimum and maximum anticipated flow rate through each. Inlet ports 16 and exhaust ports 28 are purposely positioned relative to the lobes on shaft 13.

A motor ring 14 rotates and gyrates around the lobed shaft 13 as hydraulic or pneumatic power fluid from inlet/entry port 16 enters motor cavity 70. When the inlet/entry port 16 is exposed/opened by the rotating motor ring 14, discharge port 28 is covered/closed by that same rotating motor ring 14, allowing the fluid from channels 20,17 to expand into cavity 70, causing it to expand and motor ring 14 to rotate and gyrate around the centrically positioned, non-rotating, fixed shaft 13. While cavity 70 expands, cavity 71 contracts precipitated by the covering/closing of inlet ports 16 and exposing/opening of discharge/outlet ports 28 by movement of the leading and trailing edges of motor ring 14. This alternating opening and closing of the ports for each motor cavity causes the continuous powering of the motor.

The rotating and gyrating motor ring 14 is attached to the external motor housing/tool 15 by at least one pin, with two pins 23 shown in the drawing. This attachment can be alternately provided by splines, gears, stops with springs, roller pins, or angled bars. Said attachment, by any means, causes both the ring 14 and external housing 15 to rotate in concert at the same rotational speed. Said pins 23 also serve to assist in securing housing 15 onto the motor assembly via ring holes 22. Element 26 of FIG. 6 is shown positioned between the outer housing 15 and base 25, and contains a thrust/journal bearing and hold-down latch for the housing (not shown in detail but well known in the industry).

Continuing with FIG. 6, discharge disc 27 is directly attached to shaft 13 by screws 37 into threaded holes 21 of shaft 13 and therefore does not rotate relative to the shaft 13. Said discharge disc 27 contains exhaust/exit ports 28 which are exactly drilled dimensioned and positioned to allow hydraulic/pneumatic power fluid to vacate the motor cavity 70 when rotating ring 14 exposes port 28 to cavity 70. Said discharge/exhaust ports 28 on the fixed discharge disc 27 are strategically positioned to alternate with the exposure/opening of inlet ports 16 in base 25 to cavity 70 as the motor ring 14 rotates. Alternatively and/or in addition to, the discharge disc 27 can also be screwed onto the reduced diameter neck of shaft 13 to assist, reinforce and contain the operating pressures occurring inside the motor cavity 70. End surfaces 73,74 of ring 14 are machined extremely smooth to match the extremely smooth surfaces on discharge disc 75 and base 76 faces, respectively.

Bearing disc 29 accommodates both journal and thrust loads, as required by the instant invention, and incorporates openings 30 therein to allow hydraulic fluid from the motor to pass there through to the bit. Said bearing disk 29 also provides reinforcement strength to the discharge disc 27 when held in place by nut 35. In addition, the bearing disc 29 also has flow channels 33 along its periphery to allow fluid flow leaked or directed into cavity 72 (between the motor ring 14 and housing 15) to escape to the bit 36 via channel 31. Nut 35 holds bearing disc 29 in place and provides additional strength to discharge/exhaust disc 27. Said nut can serve as a plug/cap to flow channel 20, if fluid is not to be bypassed, or contain one or more nozzles if restricted flow through channel 32 or back pressure in channel 20 is desired. It should also be noted that the said fixed nozzle, attached to the non-rotating shaft or tube, may be non-centrically oriented to allow for rock or material removal due to the jetting action ahead of the bit, but in a preferential direction. This selective or directional jetting can aid in directing the forward movement of the drilling process.

Continuing with FIG. 6, the rotating external housing 15 embodies an incorporated drilling utensil 36. Without limitation, such drilling utensils would include tools, bits and any other cutting surfaces well known to and practiced by those skilled in the art. The motor housing 15 embodies ports 32 to allow fluid to escape via central flow channel 20 and flow channels 31 for flow through the motor and bearings, and further provides for threaded holes 24 to allow pins 23 to be inserted into ring holes 22 after the motor is assembled. Said pins 23 keep the housing in sync with the internal rotating ring 14 and, along with a latch system at element 26, further secures the housing 15 firmly to the motor assembly. Both bearing disc 29 and element 26 accommodate thrust and journal loads imposed on housing 15 by the drilling process.

FIG. 7 provides additional detail with respect to element relationships of the invention's inverted gerotor motor. In this figure, lobed shaft 13 has a central channel 20 for bypassing fluid around the motor section. Threaded boltholes 21 and bolts 37 position and hold a discharge/exhaust disc 27 (not illustrated) onto shaft 13. Said bolts 37 assist in maintaining pressurized fluids within the motor (i.e. within motor ring 14, shaft 13 and base 25 and discharge/exhaust disc 27—not illustrated). While entry port 16 is exposed to cavity 70 and discharge port 28 is sealed off from said cavity by rotating motor ring 14, and the fluid will expand cavity 70 causing the ring 14 to rotate clockwise and gyrate around the center of non-rotating fixed shaft 13. While cavity 70 expands, adjacent cavity 80 contracts due to inlet port 128 being covered by ring 14 and the discharge/exhaust ports 19 exposed also by the rotating motor ring 14.

The ports (both inlet 16 and exhaust 28) for motor cavity 70 are alternately opened and closed by movement of the leading and trailing edge of the motor ring 14. The position, length, width and shape of these ports 16,28, relative to the rotor lobes, are all extremely important to achieve maximum power. Some leakage between the motor ring 14 and base 25 and exhaust/discharge disc 27 is desired for lubrication, cooling and to prevent temporary hydraulic locking.

In illustration 7, motor ring 14 is connected to the housing 15 by simple pins 23. Alternately, stops (with springs, needle roller bearings, square bars) and/or with matched coarse gearing can be used. This attachment makes the motor housing 15 rotate with motor ring 14. As the tool/bit 36 (not shown in this figure) is part of the motor housing 15, it rotates with motor ring 14 and cuts/drills the hole ahead or performs other activities.

FIG. 8 illustrates an exploded illustration of the one embodiment of the instant invention previously described in FIGS. 6–7, which further details invention element positioning and interrelationships. In FIG. 8, it is shown where element 22 illustrates a pin receptacle on a rotating ring. Element 14 illustrates the rotatable motor ring. Element 21 illustrates the threaded boltholes. Element 16 illustrates entry ports for the fluid flow into the motor section. Element 26 is intended to illustrate a generic thrust/journal bearing and hold-down latch, all well known in the industry. Element 25 shows the motor base. Element 20 illustrates a view of the central flow channel in and through the non-rotating shaft 13 and base 25. Element 20 and phantom further illustrate the internal stricture of central flow channel 20 and flow sub-channels 17 (in phantom). It further details a discharge disc 27 with discharge ports 19,28 and two other (non-numbered) ports, screws 37 for positioning and holding disc 27, periphery flow channel 33 on bearing disc 29, securing nut 35, pins 23 for attaching a motor housing 15 via threaded holes 24 into the rotatable ring 14, bearing flow channels 31, and exiting flow channel 32.

Figure 9:
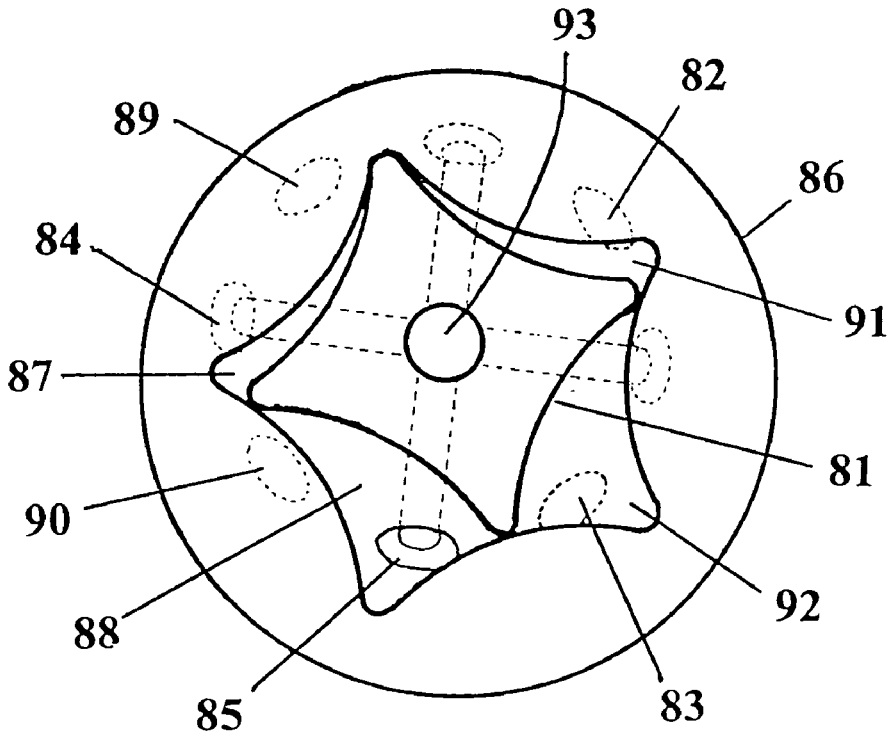
FIG. 9 is a transverse cross-sectional illustration of an eccentric hydraulic/pneumatic positive displacement Gerotor motor of the instant invention design.

FIG. 9 is a transverse cross-section illustration of a hydraulic/pneumatic Gerotor motor that is of the eccentric version of the instant invention. This eccentric Gerotor motor's operation is similar to the centric Gerotor motor version that is shown in FIGS. 6–8, but with the internal ring 86 now also the motor's housing and tool/bit 86. High pressure fluids can bypass the motor section via internal shaft channel 93. The motor ring/housing 86 operation is the same as in the concentric version with exit ports 89,90 being covered/closed and inlet ports 84,85 are exposed/opened as the motor ring 86 rotates around the fixed lobed shaft 81. The motor ring 86 uncovers/exposes inlet ports 84,85 to motor cavities 87,88 allowing entry of pressured causing said cavities 87,88 to expand. Concurrently, motor ring/housing 86 movement also opens/exposes exit ports 82,83 to cavity 91,92 allowing trapped fluids to escape to the lower pressure bit area. This alternating expansion and contraction of motor cavities 83,87,91,92 within the motor causes the motor ring/housing 86 to rotate and gyrate around the fixed lobed shaft 81. This eccentric Gerotor version allows the shaft to be larger, giving more strength to the motor and drilling assembly, for the same outer housing diameter as the concentric version.

Figure 10:
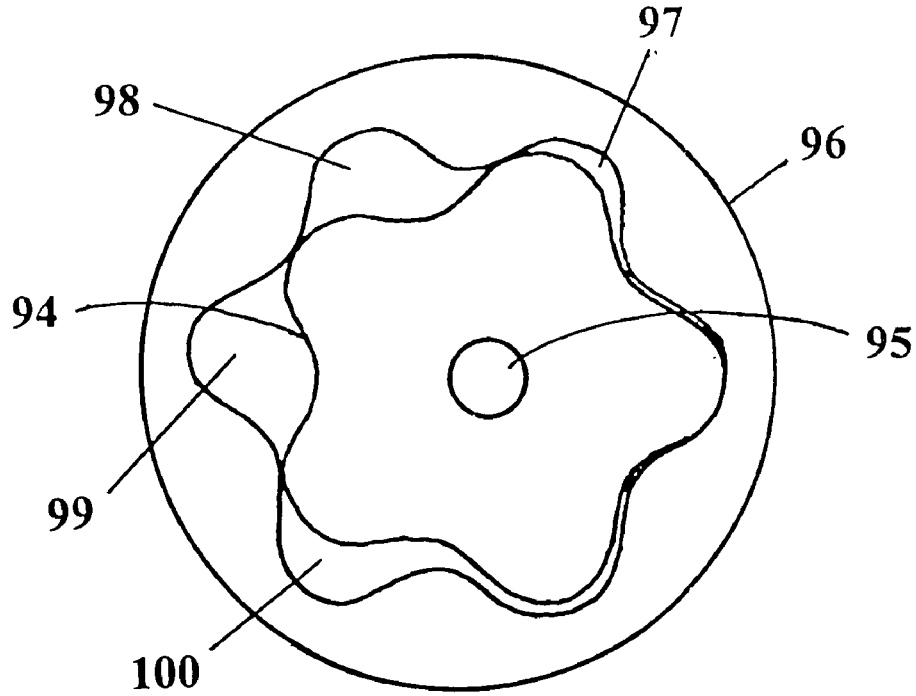
FIG. 10 is a transverse cross-sectional illustration of an eccentric hydraulic/pneumatic positive displacement Moineau motor of the instant invention design.

FIG. 10 is a transverse cross-sectional illustration of an eccentric hydraulic/pneumatic Moineau eccentric motor of the instant invention design. This is an immediate reversal of the roles of these motor elements as used in the industry today, but with the basic theory of operation the same. High-pressure fluids can bypass the motor section via internal shaft channel 95. Pressurized fluids, either at the high-pressure level of the bypassed fluids or nozzled to reduce flow rate and available pressure, enters all the open cavities 97,98,99,100 between the housing 96 and shaft 94. Progression of the pressurized fluid movement along the helical path of the motor length (not shown, but well known in the art) causes rotation of the said housing 96 around the shaft 94. The housing 96 can be made of a high grade steel alloy, stainless steel, titanium or other metals or even composite materials. Internally, the housing 96 can be coated with various elastomers for sealing or, alternately, with chrome or other high abrasive resistant materials for hardness. The shaft 94 can be made of a stainless steel or high grade steel alloy and it can be coated with an elastomer or chrome finish—to offset the internal coating of the housing 96. It must also be noted that the eccentric Moineau version can be converted to a concentric motor version, both following the instant invention, as shown in FIG. 6-8 for Gerotor motors. These inverted Moineau style versions (concentric and eccentric) are ideal motors for less clean power fluids and can be designed in an opposing motor version for balanced axial forces.

Figure 11:
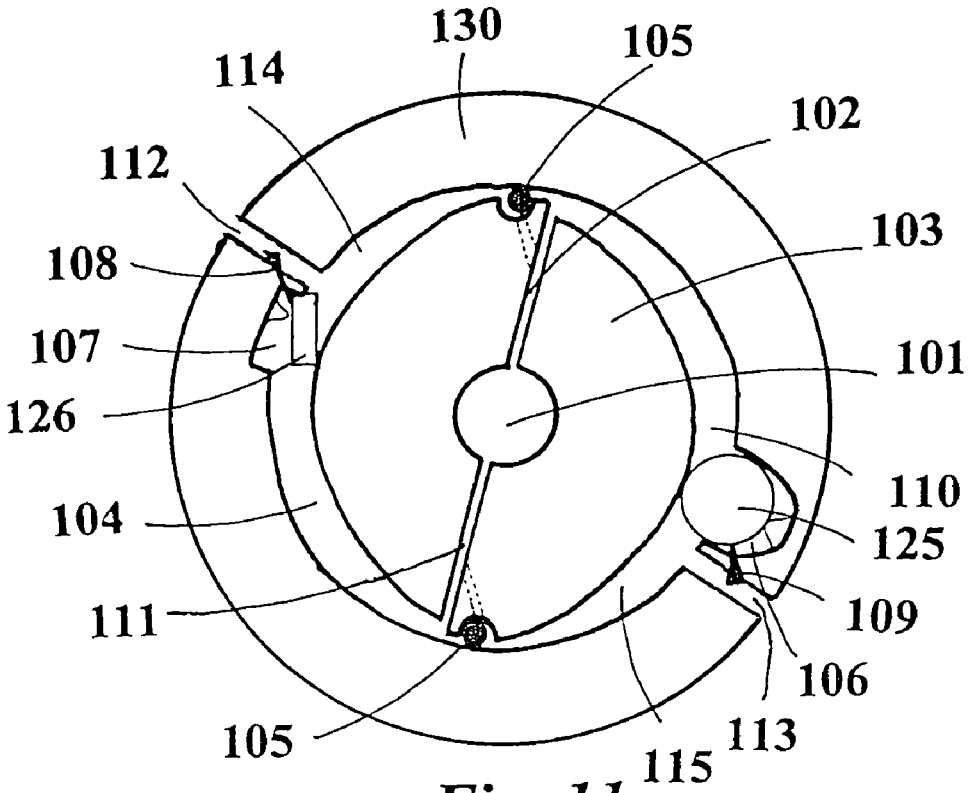
FIG. 11 is a transverse cross-sectional illustration of a hydraulic/pneumatic positive displacement motor of the instant invention design showing both wing and roller sealing methods.

FIG. 11 is a transverse cross-sectional illustration of a concentric hydraulic/pneumatic vane type motor of the instant invention design showing both wing and rod/cylinder sealing methods. Numerous methods, all well known in the industry, are available for valving and sealing, but only two (2) are shown for illustration herein. This version of a positive displacement hydraulic/pneumatic motor uses rods/cylinders 125 and/or wings/flappers 126 on the housing for sealing and for controlling exhaust valving 108,109 to the exterior of the motor housing. Either sealing mechanism can be used in these motor versions; however each method has its own abilities and limitations and should be selected for a given application. Exhaust valving can be accomplished by numerous means, other than that selected for this illustration, most of which require the use of additional rods/cylinders and/or wings/flappers to prevent mixing of high pressure fluids for expansion and exhausted fluids during contraction. Such mixing would result in loss of power Output and efficiency of the motor. High-pressure fluids pass through the interior channel 101 of shaft 103 and channels 102,111 and into motor cavities 104,110 to 103. The connecting ports 102,111 can be sized/drilled or nozzled to limit fluid entry rate and pressure to the motor section. Pressurized fluids enter motor cavities 104,110 from connecting channels 102,111 causing housing rod/cylinder 125 or housing flapper/wing 126 and rotor rods/cylinders 105 to all seal against the opposite wall from the incoming pressure. The pressure surrounding and acting on rotor rods/cylinders 105 is mostly equalized with the incoming pressurized fluids via channels 116. As the housing rotates clockwise, the elliptical large end of the shaft/rotor 103 pushes the housing rod/cylinder 125 and housing flapper/wing 126 into their respective housing recess 106,107, which contains imbedded springs, and which closes valves 108,109, temporarily shutting off exhaust ports 112,113 from the pressurized fluids coming into the motor cavity 104,110. As the sealing housing elements 125,126 rotate past the rotor's sealing cylinders 106, with the rotating housing, the exhaust valves are opened. For most of the full cycle, the exhaust ports 112,113 are open to exhaust fluids from motor cavities 114,115 as they contract. As pressurized fluids from channels 101 and 102,111 enters motor cavities 104,110 the fluids expand the cavities by totating housing 130 clockwise. Housing glapper 126 and rod/cylinder 125 are pushed against the shaft to create a moveable seal, trapping pressurized fluids in the expanding cavity. Concurrently, motor cavities 114,115 are exposed to the opened exhaust port 112,113 and those cavities contract. While specific for the exact motor design, a short 'dead' or low/no power spot in the power cycle of the motor occurs when the seal elements meet, necessitating the need for such motor to be utilized in positional series with angular offsets. In this figure, exhaust ports are directed outside of the rotating motor housing 130. Alternately, exhaust ports can be encased within the housing wall and discharged to the bit end, if the housing thickness is increased and internal channels are drilled. Other versions allow exhaust ports and channels on/in the shaft 103 at 90-degree offset to the inlet ports. Sealing rods/cylinders and flapper/wings can be made from any number of materials, including stainless steel, high-grade steel alloys, beryllium alloys and other durable materials. Materials for the shaft and housing can be as previously described.

Figure 12:
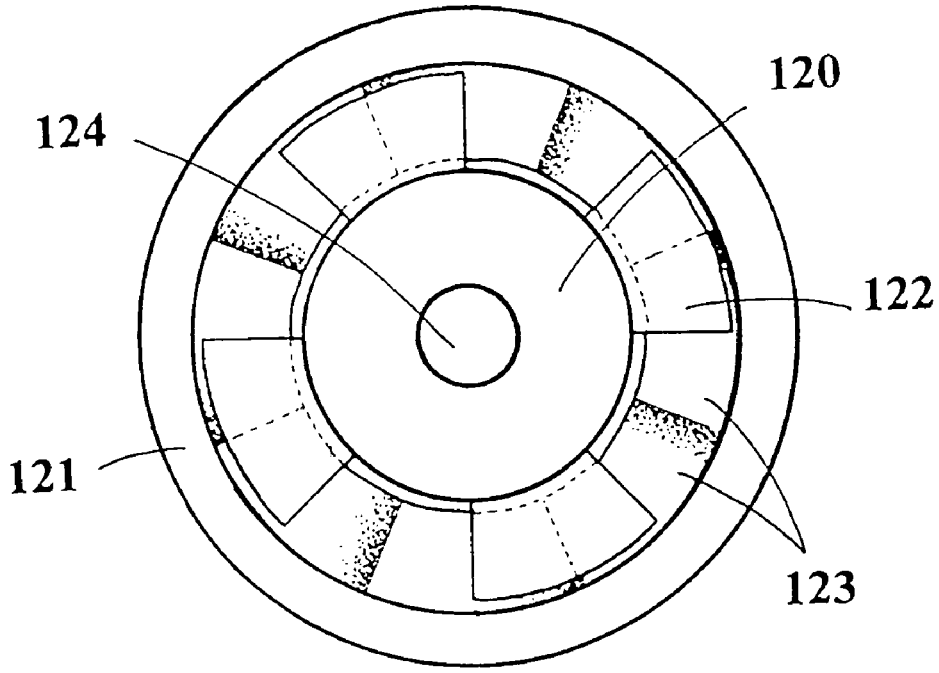
FIG. 12 is a transverse cross-sectional illustration of a hydraulic/pneumatic turbine motor of the instant invention design.

FIG. 12 is a transverse cross-sectional illustration of a simplified hydraulic/pneumatic turbine motor of the instant invention design. In the Inverted Motor electric motor design shown, high-pressure fluid volumes can bypass the motor section via the internal shaft channel 124. Pressurized power fluid volumes from the base (not shown) or from the internal channel 124 of shaft 120 into an inlet disc (not shown), nozzled or otherwise restricted, enters the full motor section to power/drive the motor. As in the general design of turbines motors, rows of blades are alternately attached to the shaft 120 (now fixed) and housing 121 (now rotating), with each row having an opposite attack angle to the axial fluid flow. Flow redirection by each row of turbine blades, alternating between rotor blades 122 and housing blades 123, cause momentum and mass impingement on each turbine blade thereby causing an angular force/torque and movement to be imparted onto the motor housing 121. The number of blades 122,123 in each row and angle of attack of each row is highly variable for each application (torque and revolution speed) and fluids used. In this illustration, half (4 out of 8) of the blades 122 in the front row that are attached to the shaft 120 have been removed to allow viewing of the next rows (8 of 8) of blades 123 attached to the housing 121. Inverted Motors made of opposing series turbines can be of an all-metal design for high temperature and corrosive fluids applications and minimal seal design.

Figure 13:
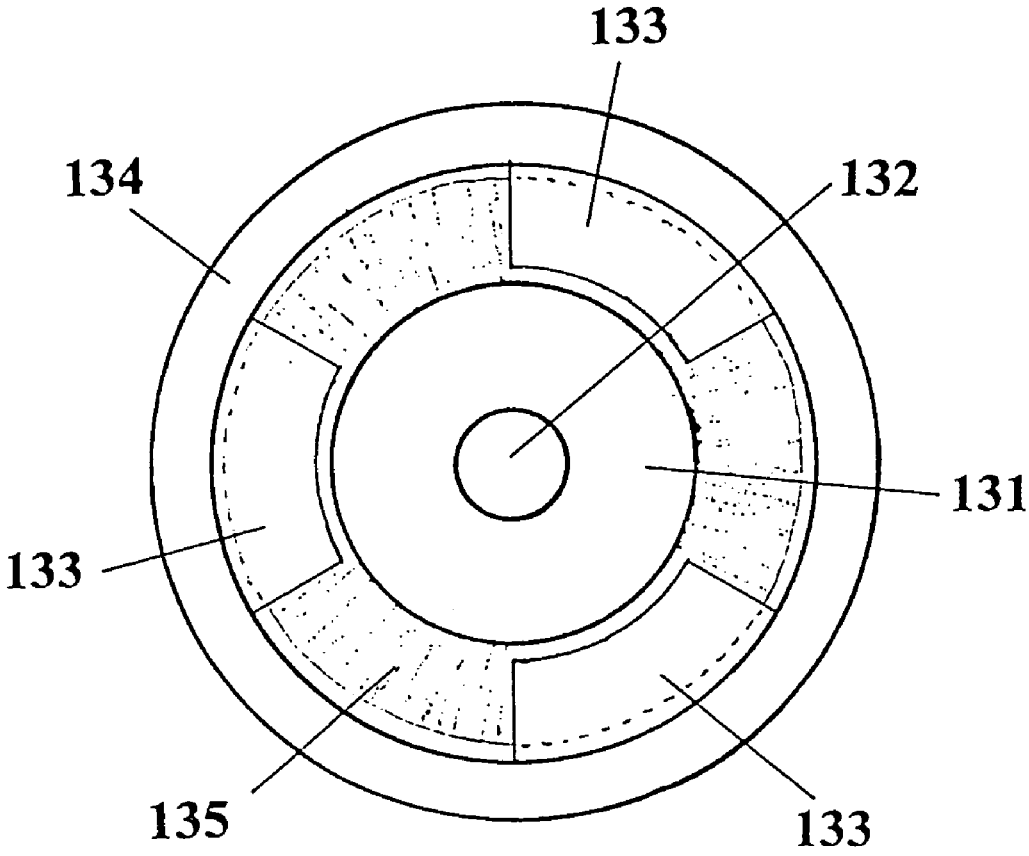
FIG. 13 is a transverse cross-sectional illustration of an electric motor of the instant invention design.

FIG. 13 is a transverse cross-sectional illustration of an electric motor of the instant invention design. Fluid flow through the base (not shown) and interior shaft channel(s) 132 allows cooling of the bearings at the housing-base junction and cooling of bearings and the coil along the entire motor and shaft 131 length. This high-pressure fluid is fully contained within the base and internal shaft/tube channel 132 and does not enter the motor section, thus power fluids of any type or quality can be used. Fluid flow continues past the motor section, down the length of the shaft/tube channel 132 until it is utilized to jet drill ahead of the bit and/or clean the cuttings at the drill bit/utensil tip and keep the wellbore hole clean. The pressurized power fluid can also contain solids for abrasive jet drilling. The motor's coils (or equivalent) 135 are attached to the shaft 131 and can be energized by alternating current (AC) or direct current (DC) electrical power input, or controlled/regulated versions of either power source. Electrical power to the coils can be provided via a base connection or via electrical wires through internal shaft channels similar or parallel to channel 132 in shaft 131. It should be noted that the electrical wiring and fluid flow need not be in the same shaft channel(s). Magnets 133 (permanent or otherwise) are attached to the motor housing 134 and react to the energized coils 135 on the shaft 131 with a resultant angular torque to the housing 134, causing power and rotation of the housing 134 and attached/integral drilling utensil.

Figure 14:
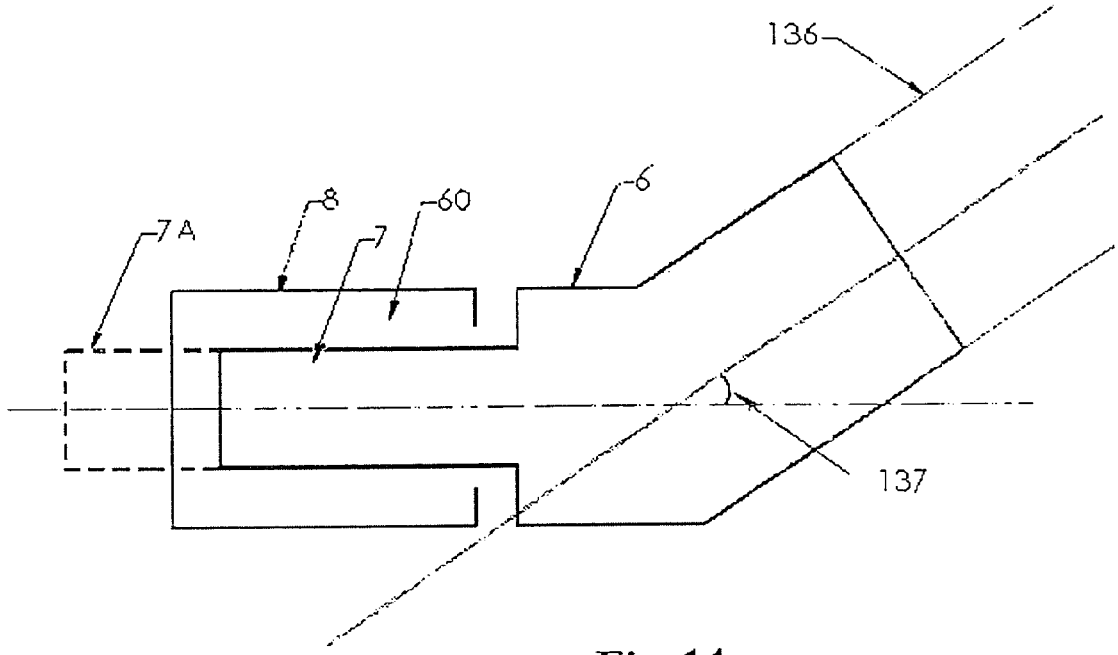
FIG. 14 is a simplified longitudinal cross sectional drawing of an alternate embodiment of the inverted motor with a bend in the base.

FIG. 14 shows an alternate embodiment of the inverted motor with a bend in the base 6 causing a non-zero angle 137 difference between the axis of the connecting hollow tubular drill string 136 and the axis of the shaft 7 and rotating housing 8. Shaft extension 7A shows that the shaft 7 can be extended forward and past the end of the motor 60 or housing 8 section.

Figure 15:
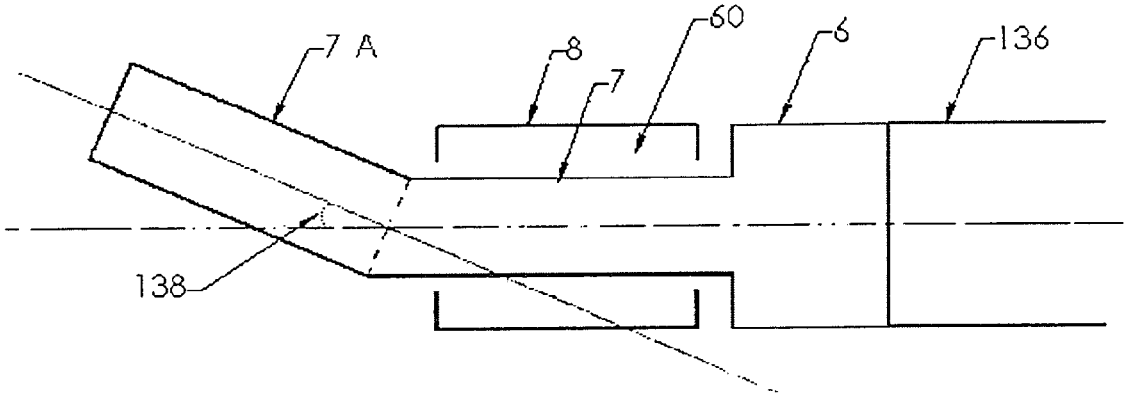
FIG. 15 is a simplified longitudinal cross sectional drawing of an alternate embodiment of the inverted motor with a bend in the shaft forward of the housing.

FIG. 15 shows an alternate embodiment of the inverted motor with a bend in the shaft (at the junction between 7 and 7A) that extends past the housing 8 causing a non-zero angle 138 difference between the axis of the shaft 7 and the axis of the shaft extension 7A. In the case given, it also causes a difference in the axis of the leading edge of the shaft 7A to the base 6 and the connecting hollow tubular drill string 136.

While the making and using of various embodiments of the present invention are discussed in detail above, it should be appreciated that the present invention provides for inventive concepts capable of being embodied in a variety of specific contexts. The specific embodiments discussed herein are merely illustrative of some specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definitions of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

It will be apparent to those skilled in the art that various modifications and variations can be made in the construction, configuration, and/or operation of the present invention without departing from the scope or spirit of the invention. For example, in the embodiments mentioned above, variations in the materials used to make each element of the invention may vary without departing from the scope of the invention. Thus, it is intended that the present invention cover the modifications and variations of the invention provided they come within the scope of the appended claims and their equivalents.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed:

1. An inverted motor for drilling comprising:

a motor base in communication with a non-rotating shaft;

a rotatable external motor housing;

at least one motor cavity formed and positioned between said rotatable housing and said non-rotating shaft with said non-rotating shaft passing axially through said housing;

a drilling utensil attached to said motor housing;

a motor positioned within said motor cavity wherein said motor is fluid activated; and at least one channel in said non-rotating shaft extending from said motor base into said motor cavity with at least one entrance aperture in communication with said motor base and at least one exit aperture in communication with said motor cavity.

2. The motor of claim 1 wherein said drilling utensil is integrated as a portion of said motor housing.

3. The motor as set forth in claim 1 wherein said non-rotating shaft traverses and extends beyond an internal portion of said housing.

4. An inverted motor as set forth in claim 1 wherein said fluid activated motor is hydraulically activated.

5. An inverted motor as set forth in claim 1 wherein said fluid activated motor is pneumatically activated.

6. An inverted motor as set forth in claim 1 wherein said motor is a positive displacement motor.

7. An inverted motor as set forth in claim 1 wherein said motor is a turbine motor.

8. An inverted motor as set forth in claim 1 wherein said motor is a vane type motor.

9. An inverted motor as set forth in claim 8 wherein said motor is a roller vane type motor.

10. An inverted motor as set forth in claim 1 wherein said motor is a wing type motor.

11. An inverted motor as set forth in claim 1 wherein said motor is a Moineau or progressing cavity type motor.

12. An inverted motor as set forth in claim 1 wherein said motor is a Gerotor motor.

13. The motor of claim 1 wherein said motor base has an angled or bent orientation.

14. The motor of claim 1 wherein a portion of the said shaft that extends beyond a forward end of the drilling utensil and has an angled or bent orientation as related to an axis of the housing and base.

15. The motor of claim 1 further comprising a means for providing more than one motor in positional series and facilitating power fluid flow progression sequentially through each motor.

16. The motor of claim 15 wherein said motor is arranged in positional series with each motor or motor stage angularly offset to one another.

17. The motor of claim 15 further comprising a means for substantially balancing generated axial forces of said motor via internal design of opposing motors or motor stages.

18. The inverted motor of claim 15 wherein motors with balanced rotation directions offset each other to transmit a substantially balanced net torque to a hollow tubular string.

19. The motor of claim 1 further comprising a means for providing more than one motor in positional series and facilitating power fluid flow progression in parallel through each motor or motor stage.

20. The motor of claim 19 wherein said motor is arranged in positional series with each motor or motor stage angularly offset to one another.

21. The motor of claim 19 further comprising a means for substantially balancing generated axial forces of said motor via internal design of opposing motors.

22. The inverted motor of claim 19 wherein motors with balanced rotation directions offset each other to transmit a substantially balanced net torque to a hollow tubular string.

23. The motor of claim 1 further comprising a means for providing for installation of wires or cables through a central shaft channel thereby bypassing any given motor section or motor stage.

24. The inverted motor of claim 1 wherein said rotation can proceed in either a clockwise or counter-clockwise rotation.

25. The motor of claim 1 wherein pressurized fluid is pumped to said motor base and is predominately a gaseous composition at atmospheric conditions.

26. The inverted motor of claim 1 further comprising an off-axis oriented nozzle or nozzle device attached to said non-rotating shaft at said exit aperture after said shaft passes through said motor cavity.

27. A method to actuate an inverted motor and rotate a drilling utensil within a bore comprising:

pumping a fluid to a base of an inverted motor;

diverting the flow of said fluid pumped to said base into a first direction to allow entry of said fluid into a channel located within the interior of a non-rotating shaft and/or into a second direction to allow said fluids into a motor cavity located between a rotatable motor housing and said non-rotating shaft;

exiting of said fluid entering said non-rotating shaft channel via a shaft exiting port or nozzle; and exiting of said fluid entering said motor cavity via at least one flow channel exiting port.

28. The method of claim 27 including passage of wires through said non-rotating shaft and wherein said fluid or wires can be diverted and either fully or partially bypass said motor cavity via direction of said fluid or wires in the internal channel of said non-rotating shaft.

29. The method of claim 27 including passage of wires through said non-rotating shaft and wherein the entering and exiting of said fluid or wires occurs at a location variably positioned along the length of said shaft's internal channel.

30. The method of claim 27 further comprising:

rotating and/or gyrating said rotatable motor housing with a drilling utensil attached thereto circumferentially around said non-rotating shaft as said fluid traverses said motor cavity; and coordinating entry and discharge of fluid traversing said motor cavity via the alternate opening and closing of inlet and outlet fluid flow ports.

31. An inverted motor for drilling comprising:

a motor base in communication with a non-rotating shaft;

a rotatable external motor housing;

at least one motor cavity formed and positioned between said rotatable housing and said non-rotating shaft with said non-rotating shaft passing axially through said housing;

a drilling utensil attached to said motor housing;

a motor positioned within said motor cavity wherein said motor is fluid activated; and at least one channel in said non-rotating shaft extending from said motor base through said motor cavity with at least one entrance aperture in communication with said motor base and at least one exit aperture.

* * * * *